US006610468B2

(12) United States Patent
Katoh et al.

(10) Patent No.: US 6,610,468 B2
(45) Date of Patent: Aug. 26, 2003

(54) SILVER HALIDE PHOTOGRAPHIC MATERIAL

(75) Inventors: Takashi Katoh, Kanagawa (JP); Tomoyuki Ohzeki, Kanagawa (JP); Katsutoshi Yamane, Kanagawa (JP); Takanori Hioki, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/828,801

(22) Filed: Apr. 10, 2001

(65) Prior Publication Data

US 2002/0051950 A1 May 2, 2002

(30) Foreign Application Priority Data

Apr. 10, 2000 (JP) ..... P. 2000-108181

(51) Int. Cl.[7] ..... G03C 1/005; G03C 1/494

(52) U.S. Cl. ..... 430/592; 430/591; 430/570; 430/576; 430/577

(58) Field of Search ..... 430/570, 592, 430/591, 576, 577

(56) References Cited

U.S. PATENT DOCUMENTS 5,565,307 A * 10/1996 Hioki et al. ..... 430/570

FOREIGN PATENT DOCUMENTS

JP 7-287337 * 10/1995
JP 10-254085 * 9/1998
JP 10-254085 A * 9/1998
JP A1165017 3/1999
JP 2000-275774 * 10/2000
JP 2000-275774 A * 10/2000
JP 2000-330229 * 11/2000

* cited by examiner

*Primary Examiner*—Geraldine Letscher
(74) *Attorney, Agent, or Firm*—Birch, Stewart, Kolasch & Birch, LLP

(57) ABSTRACT

A silver halide photographic material having high sensitivity, low fog and good shelf life (i.e., storage stability), which comprises at least one kind of merocyanine dye represented by formula (I):

(I)

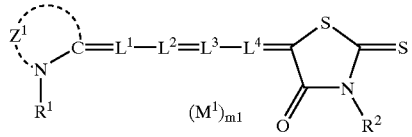

wherein $Z^1$ represents an atomic group necessary for forming a naphthoxazole ring, $R^1$ and $R^2$ each represents an unsubstituted or substituted alkyl group, an aryl group or a heterocyclic group, $L^1$, $L^2$, $L^3$ and $L^4$ each represents a methine group, $M^1$ represents a charge neutralizing counter ion, and $m^1$ is a number of 0 or more necessary for neutralizing a charge in a molecule.

20 Claims, No Drawings

SILVER HALIDE PHOTOGRAPHIC MATERIAL

FIELD OF THE INVENTION

The present invention relates to a silver halide photographic material, and particularly to a photothermographic material.

BACKGROUND OF THE INVENTION

In the recent medical diagnostic film field and photomechanical film field, it has been eagerly desired to reduce the amount of processing waste fluid, from the viewpoints of environmental preservation and space saving. Accordingly, techniques relating to photothermographic materials have been required as medical diagnostic films and photomechanical films which can be efficiently exposed with a laser image setter or a laser imager and can form sharp black images having high resolution. These photothermographic materials can dispense with the use of processing chemicals of the solution system, so that they can provide to customers heat development processing systems which are simpler and do not damage the environment.

There is also a similar demand in the field of general image formation materials. However, images for medical diagnosis particularly require fine depictions, so that high image quality excellent in sharpness and graininess is necessary. Moreover, they are characterized by that blue black tone images are preferred from the view point of ease of diagnosis. At present, various kinds of hard copy systems utilizing dyes or pigments, such as ink jet printers and electrophotogarphy, are in circulation as general image formation systems. However, they are not satisfactory as output systems of medical images.

On the other hand, heat image formation systems utilizing organic silver salts are described, for example, in U.S. Pat. Nos. 3,152,904 and 3,457,075, and D. Klosterboer, *Thermally Processed Silver Systems* (*Image Processes and Materials*), Neblette, the eighth edition, edited by J. Sturge, V. Walworth and A. Shepp, chapter 9, page 279 (1989). In particular, photothermographic materials generally have light-sensitive layers in which catalytic active amounts of photocatalysts (for example, silver halides), reducing agents, reducible silver salts (for example, organic silver salts) and optionally color toning agents for controlling a color tone of silver are dispersed in binder matrixes. After image exposure, the photothermographic materials are heated to a high temperature (or example, 80° C. or more) to form black silver images by the oxidation-reduction reaction between the reducible silver salts (which act as oxidizing agents) and the reducing agents. The oxidation-reduction reaction is promoted by the catalysis of latent images of silver halides generated by exposure. The black silver images are therefore formed in exposed regions. These are disclosed in many literatures including U.S. Pat. No. 2,910,377 and JP-B-43-4924 (the term "JP-B" as used herein means an "examined Japanese patent publication").

However, in the organic silver salt-containing photothermographic materials, even the use of sensitizing dyes which can absorb red laser beams has still raised problems with regard to the appearance of fog not practically negligible and changes in performance during storage, although they are alleviated by infrared dyes.

SUMMARY OF THE INVENITON

An object of the present invention is to provide a silver halide photographic material, particularly a photothermographic material, having high sensitivity, low fog and good shelf life (i.e., good storage stability).

The above-described object has been attained by the following means:

(1) A silver halide photographic material comprising at least one kind of merocyanine dye represented by formula (I)

(I)

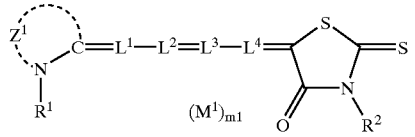

wherein $Z^1$ represents an atomic group necessary for forming a naphthoxazole ring, $R^1$ and $R^2$ each represents an unsubstituted or substituted alkyl group, an aryl group or a heterocyclic group, $L^1$, $L^2$, $L^3$ and $L^4$ each represents a methine group, $M^1$ represents a charge neutralizing counter ion, and $m^1$ is a number of 0 or more necessary for neutralizing a charge in a molecule.

(2) The silver halide photographic material described in (1), wherein said merocyanine dye represented by formula (I) is a merocyanine dye represented by formula (II):

(II)

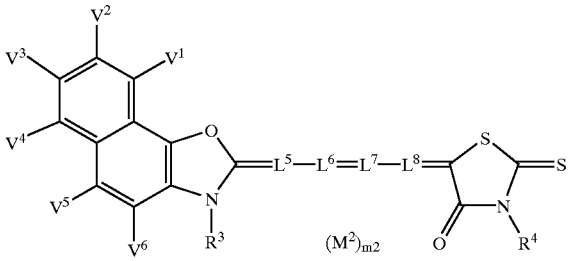

wherein $R^3$ and $R^4$ each represents an unsubstituted or substituted alkyl group, an aryl group or a heterocyclic group, $V^1$, $V^2$, $V^3$, $V^4$, $V^5$ and $V^6$ each represents a hydrogen atom or a substituent, $L^5$, $L^6$, $L^7$ and $L^8$ each represents a methine group, $M^2$ represents a charge neutralizing counter ion, and $m^2$ is a number of 0 or more necessary for neutralizing a charge in a molecule.

(3) A photothermographic material having a support containing at least one kind of light-sensitive silver halide, a light-insensitive organic silver salt, a reducing agent for a silver ion and a binder in one face thereof, which comprises at least one kind of merocyanine dye represented by formula (I) or (II):

(I)

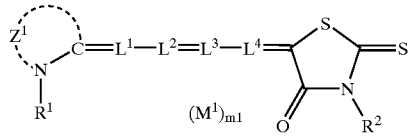

wherein $Z^1$ represents an atomic group necessary for forming a naphthoxazole ring, $R^1$ and $R^2$ each represents an unsubstituted or substituted alkyl group, an aryl group or a heterocyclic group, $L^1$, $L^2$, $L^3$ and $L^4$ each represents a methine group, $M^1$ represents a charge neutralizing counter ion, and $m^1$ is a number of 0 or more necessary for neutralizing a charge in a molecule; and (II)

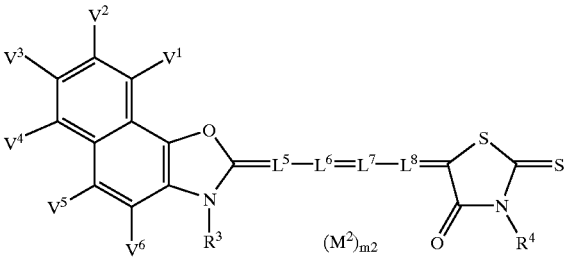

wherein $R^3$ and $R^4$ each represents an unsubstituted or substituted alkyl group, an aryl group or a heterocyclic group, $V^1$, $V^2$, $V^3$, $V^4$, $V^5$ and $V^6$ each represents a hydrogen atom or a substituent, $L^5$, $L^6$, $L^7$ and $L^8$ each represents a methine group, $M^2$ represents a charge neutralizing counter ion, and $m^2$ is a number of 0 or more necessary for neutralizing a charge in a molecule.

(4) The silver halide photographic material described in (2), wherein $R^4$ in the merocyanine dye represented by formula (II) is a carboxymethyl group.

(5) The photothermographic material described in (3), wherein $R^4$ in the merocyanine dye represented by formula (II) is a carboxymethyl group.

(6) The silver halide photographic material described in (2), wherein $V^1$, $V^2$, $V^3$, $V^4$, $V^5$ and $V^6$ in the merocyanine dye represented by formula (II) are hydrogen atoms.

(7) The photothermographic material described in (3), wherein $V^1$, $V^2$, $V^3$, $V^4$, $V^5$ and $V^6$ in the merocyanine dye represented by formula (II) are hydrogen atoms.

(8) A silver halide photographic material comprising at least one kind of merocyanine dye represented by formula (II) and at least one kind of merocyanine dye represented by formula (III):

(II)

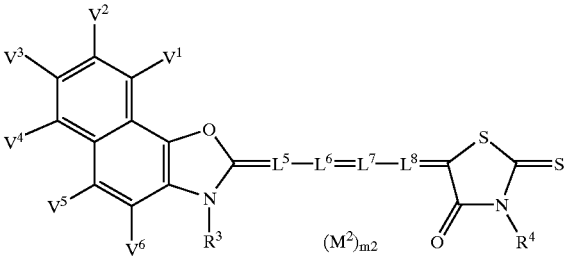

wherein $R^3$ and $R^4$each represents an unsubstituted or substituted alkyl group, an aryl group or a heterocyclic group, $V^1$, $V^2$, $V^3$, $V^4$, $V^5$ and $V^6$ each represents a hydrogen atom or a substituent, $L^5$, $L^6$, $L^7$ and $L^8$ each represents a methine group, $M^2$ represents a charge neutralizing counter ion, and $m^2$ is a number of 0 or more necessary for neutralizing a charge in a molecule; and (III)

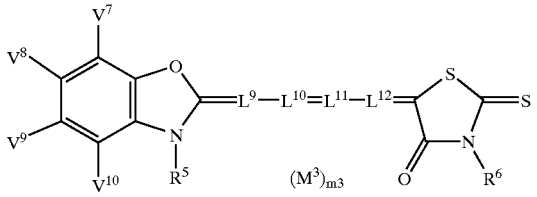

wherein $R^5$ and $R^6$ each represents an unsubstituted or substituted alkyl group, an aryl group or a heterocyclic group, $V^7$, $V^8$, $V^9$ and $V^{10}$ each represents a hydrogen atom or a substituent, $L^9$, $L^{10}$, $L^{11}$ and $L^{12}$ each represents a methine group, $M^3$ represents a charge neutralizing counter ion, and $m^3$ is a number of 0 or more necessary for neutralizing a charge in a molecule.

(9) The silver halide photographic material described in (8), wherein $V^7$ and $V^{10}$ in the merocyanine dye represented by formula (III) are each a hydrogen atom, and $V^8$ and $V^9$ therein are each an unsubstituted or substituted alkyl group.

(10) The silver halide photographic material described in (2), wherein $R^5$ in the merocyanine dye represented by formula (II) is an unsubstituted alkyl group having 5 to 10 carbon atoms.

(11) The phot-thermographic material described in (3), wherein $R^5$ in the merocyanine dye represented by formula (II) is an unsubstituted alkyl group having 5 to 10 carbon atoms.

(12) The silver halide photographic material described in (8), wherein $R^5$ in the merocyanine dye represented by formula (II) is an unsubstituted alkyl group having 5 to 10 carbon atoms.

(13) The silver halide photographic material described in (2), wherein a silver halide emulsion containing the merocyanine dye represented by formula (II) is sensitized with a tellurium sensitizer.

(14) The photothermographic material described in (3), wherein a silver halide emulsion containing the merocyanine dye represented by formula (II) is sensitized with a tellurium sensitizer.

(15) The silver halide photographic material described in (8), wherein a silver halide emulsion containing the merocyanine dye represented by formula (II) is sensitized with a tellurium sensitizer.

DETAILED DESCRIPTION OF THE INVENTION

Formulas (I) to (III) will be described in more detail below.

$Z^1$ represents an atomic group necessary for forming a naphthoxazole ring. As $Z^1$, naphto[2,1-d]oxazole, naphto[2,3-d]oxazole and naphto[1,2-d]oxazole rings are exemplified. These rings may be further substituted. Although there is no particular limitation on the substituent, examples of the substituent include a halogen atom (e.g., chlorine, bromine, iodine or fluorine), a mercapto group, a cyano group, a carboxyl group, a phosphoric acid group, a sulfo group, a hydroxyl group, a carbamoyl group having from 1 to 10 carbon atoms, preferably from 2 to 8 carbon atoms and more preferably from 2 to 5 carbon atoms (e.g., methylcarbamoyl, ethylcarbamoyl or morpholinocarbonyl), a sulfamoyl group having from 0 to 10 carbon atoms, preferably from 2 to 8 carbon atoms and more preferably from 2 to 5 carbon atoms (e.g., methylsulfamoyl, ethylsulfamoyl or piperidinosulfonyl), a nitro group, an alkoxyl group having from 1 to 20 carbon atoms, preferably from 1 to 10 carbon atoms and more preferably from 1 to 8 carbon atoms (e.g., methoxy, ethoxy, 2-methoxy or 2-phenylethoxy), an aryloxy group having from 6 to 20 carbon atoms, preferably from 6 to 12 carbon atoms and more preferably from 6 to 10 carbon atoms (e.g., phenoxy, p-methylphenoxy, p-chlorophenoxy or naphthoxy), an acyl group having form 1 to 20 carbon atoms, preferably from 2 to 12 carbon atoms and more preferably from 2 to 8 carbon atoms (e. g., acetyl, benzoyl or trichloroacetyl), an acyloxy group having form 1 to 20 carbon atoms, preferably from 2 to 12 carbon atoms and more preferably from 2 to 8 carbon atoms (e.g., acetyloxy or benzoyloxy), an acylamino group having form 1 to 20 carbon atoms, preferably from 2 to 12 carbon atoms and more preferably from 2 to 8 carbon atoms (e. g. , acetylamino), a sulfonyl group having form 1 to 20 carbon atoms, preferably from 1 to 10 carbon atoms and more preferably from 1 to 8 carbon atoms (e.g., methanesulfonyl, ethanesulfonyl or benzenesulfonyl), a sulfinyl group having form 1 to 20 carbon atoms, preferably from 1 to 10 carbon atoms and more preferably from 1 to 8 carbon atoms (e.g., methanesulfinyl, ethanesulfinyl or benzenesulfinyl), a sulfonylamino group having form 1 to 20 carbon atoms, preferably from 1 to 10 carbon atoms and more preferably from 1 to 8 carbon atoms (e.g., methanesulfonylamino, ethanesulfonylamino or benzenesulfonylamino), an amino group, a substituted amino group having form 1 to 20 carbon atoms, preferably from 1 to 12 carbon atoms and more preferably from 1 to 8 carbon atoms (e.g., methylamino, dimethylamino, benzylamino, anilino or diphenylamino), an ammonium group having form 0 to 15 carbon atoms, preferably from 3 to 10 carbon atoms and more preferably from 3 to 6 carbon atoms (e.g., trimethylammonium or triethylammonium), a hydrazino group having form 0 to 15 carbon atoms, preferably from 1 to 10 carbon atoms and more preferably from 1 to 6 carbon atoms (e.g., trimethylhydrazino), an ureido group having form 1 to 15 carbon atoms, preferably from 1 to 10 carbon atoms and more preferably from 1 to 6 carbon atoms (e. g., ureido or N,N-dimethylureido), an imido group having form 1 to 15 carbon atoms, preferably from 1 to 10 carbon atoms and more preferably from 1 to 6 carbon atoms (e.g., succinimido), an alkylthio group having form 1 to 20 carbon atoms, preferably from 1 to 12 carbon atoms and more preferably from 1 to 8 carbon atoms (e.g., methylthio, ethylthio or propylthio), an arylthio group having form 6 to 20 carbon atoms, preferably from 6 to 12 carbon atoms and more preferably from 6 to 10 carbon atoms (e.g., phenylthio, p-methylphenylthio, p-chlorophenylthio, 2-pyridylthio or naphthylthio), an alkoxycarbonyl group having form 2 to 20 carbon atoms, preferably from 2 to 12 carbon atoms and more preferably from 2 to 8 carbon atoms (e. g. , methoxycarbonyl, ethoxycarbonyl or 2-benzyloxycarbonyl), an aryloxycarbonyl group having form 6 to 20 carbon atoms, preferably from 6 to 12 carbon atoms and more preferably from 6 to 10 carbon atoms (e.g., phenoxycarbonyl) an unsubstituted alkyl group having form 1 to 18 carbon atoms, preferably from 1 to 10 carbon atoms and more preferably from 1 to 5 carbon atoms (e.g., methyl, ethyl, propyl or butyl), a substituted alkyl group having form 1 to 18 carbon atoms, preferably from 1 to 10 carbon atoms and more preferably from 1 to 5 carbon atoms (e.g., hydroxymethyl, trifluoromethyl, benzyl, carboxyethyl, ethoxycarbonylmethyl or acetylaminomethyl, wherein an unsaturated hydrocarbon group having form 2 to 18 carbon atoms, preferably from 3 to 10 carbon atoms and more preferably from 3 to 5 carbon atoms (e. g., vinyl, ethynyl, 1-cyclohexenyl, benzylidyne or benzylidene) shall be included in the substituted alkyl group), a substituted or unsubstituted aryl group having form 6 to 20 carbon atoms, preferably from 6 to 15 carbon atoms and more preferably from 6 to 10 carbon atoms (e.g., phenyl, naphthyl, p-carboxyphenyl, p-nitrophenyl, 3,5-dichlorophenyl, p-cyanophenyl, m-fluorophenyl or p-tolyl), and a substituted or unsubstituted heterocyclic group having form 1 to 20 carbon atoms, preferably from 2 to 10 carbon atoms and more preferably from 4 to 6 carbon atoms (e.g., pyridyl, 5-methylpyridyl, thienyl, furyl, morpholino or tetrahydrofurfuryl). They may also have a structure condensed with benzene rings or naphthalene rings. The group of these substituents is hereinafter referred to as substituent group V.

Further, these substituents may be substituted by the substituents hitherto described. As the substituents, preferred are halogen atoms, alkoxyl groups, aryl groups or alkyl groups.

$Z^1$ is preferably a naphtho[2,1-d]oxazole ring, and particularly preferably an unsubstituted naphtho[2,1-d]oxazole ring.

$R^1$, $R^2$, $R^3$, $R^4$, $R^5$ and $R^6$ each represents an alkyl group, an aryl group or a heterocyclic group, which may be further substituted. Specific examples of $R^1$, $R^3$ and $R^5$ include an unsubstituted alkyl group having form 1 to 18 carbon atoms, preferably from 1 to 7 carbon atoms and particularly preferably from 1 to 4 carbon atoms (e.g., methyl, ethyl, propyl, isopropyl, butyl, isobutyl, hexyl, octyl, dodecyl or octadecyl); a substituted alkyl group having form 1 to 18 carbon atoms, preferably from 1 to 7 carbon atoms and particularly preferably from 1 to 4 carbon atoms (e.g., alkyl groups substituted by substituent group V described above as the substituents, preferably an aralkyl group (e.g., benzyl or 2-phenylethyl), an unsubstituted hydrocarbon group (e.g., allyl), a hydroxyalkyl group (e.g., 2-hydroxyethyl or 3-hydroxypropyl), a carboxyalkyl group (e.g., 2-carboxyethyl, 3-carboxypropyl, 4-carboxybutyl or carboxymethyl), an alkoxyalkyl group (e.g., 2-methoxyethyl or 2-(2-methoxyethoxy)ethyl), an aryloxyalkyl group (e.g., 2-phenoxyethyl or 2-(1-naphthoxy)ethyl), an alkoxycarbonylalkyl group (e.g., ethoxycarbonylmethyl or 2-benzyloxycarbonylethyl), an aryloxycarbonylalkyl group (e.g. 3-phenoxycarbonylpropyl), an acyloxyalkyl group (e.g., 2-acetyloxyethyl), an acylalkyl group (e.g. , 2-acetylethyl), a carbamoylalkyl group (e.g., 2-morpholinocarbonylethyl), a sulfamoylalkyl group (e.g., N,N-dimethylcarbamoylmethyl), a sulfoalkyl group (e.g., 2-sulfoethyl, 3-sulfopropyl 3-sulfobutyl, 4-sulfobutyl, 2-[3-sulfopropoxy]ethyl, 2-hydroxy-3-sulfopropyl or 3-sulfopropoxyethoxyethyl), a sulfoalkenyl group, a sulfatoalkyl group (e.g., 2-sulfatoethyl, 3-sulfatopropyl or 4-sulfatobutyl), a heterocycle-substituted alkyl group (e.g., 2-(pyrrolidine-2-one-1-yl)ethyl or tetrahydrofurfuryl) and an alkylsulfonylcarbamoylmethyl group (e.g., methanesulfonylcarbamoylmethyl); an unsubstituted aryl group having form 6 to 20 carbon atoms, preferably from 6 to 10 carbon atoms and more preferably from 6 to 8 carbon atoms (e.g., phenyl or 1-naphthyl); a substituted aryl group having form 6 to 20 carbon atoms, preferably from 6 to 10 carbon atoms and more preferably from 6 to 8 carbon atoms (e.g., aryl groups substituted by substituent group V described above as the examples of the substituents, such as p-methoxyphenyl, p-methylphenyl and p-chlorophenyl); an unsubstituted heterocyclic group having form 1 to 20 carbon atoms, preferably from 3 to 10 carbon atoms and more preferably from 4 to 8 carbon atoms (e.g., 2-furyl, 2-thienyl, 2-pyridyl, 3-pyrazolyl, 3-isooxazolyl, 3-isothiazolyl, 2-imidazolyl, 2-oxazolyl, 2-thazolyl, 2-pyridazyl, 2-pyrimidyl, 3-pyrazyl, 2-(1,3,5-triazolyl), 3-(1,2,4-triazolyl) or 5-tetrazolyl); and a substituted heterocyclic group having form 1 to 20 carbon atoms, preferably from 3 to 10 carbon atoms and more preferably from 4 to 8 carbon atoms (e.g., heterocyclic groups substituted by substituent group V described above as the examples of the substituents, such as 5-methyl-2-thienyl or 4-methoxy-2-pyridyl). Examples of substituents for the alkyl groups preferably include a hydroxyl group, a carboxyl group, a sulfo group, a sulfato group, a phosphono group, an alkylsulfonylcarbamoyl group (e.g., methanesulfonylcarbamoyl), an acylcarbamoyl group (e.g., acetylcarbamoyl), an acylsulfamoyl group (e.g., acetylsulfamoyl), an alkylsulfonylsulfamoyl group (e.g., methanesulfonylsulfamoyl), an aryl group, an alkoxyl group and an aryloxy group. More preferred is a sulfo group among these.

$R^1$, $R^3$ and $R^5$ are each preferably an unsubstituted alkyl group having form 1 to 18 carbon atoms (e.g., methyl, ethyl, propyl, octyl, decyl, dodecyl or octadecyl), or a sulfoalkyl group (e.g., sulfobutyl or sulfopropyl), and particularly preferably an unsubstituted alkyl group having from 5 t 10 carbon atoms (e.g., n-octyl or n-pentyl).

$R^2$, $R^4$ and $R^6$ are each preferably an unsubstituted alkyl group having form 1 to 18 carbon atoms (e.g., methyl, ethyl, propyl, isopropyl, butyl, isobutyl, hexyl, octyl, dodecyl or octadecyl). As a substituted alkyl group, preferred is an aralkyl group (e.g., benzyl or 2-phenylethyl), a hydroxyalkyl group (e.g., 2-hydroxyethyl or 3-hydroxypropyl), a mercaptoalkyl group (e.g., 2-mercaptoethyl), a carboxyalkyl group (e.g., carboxymethyl, 2-carboxyethyl, 3-carboxypropyl, or 4-carboxybutyl), an alkoxyalkyl group (e.g., 2-methoxyethyl, 2-(2-hydroxyethoxy)ethyl or 2-(2-methoxyethoxy)ethyl), an aryloxyalkyl group (e.g., 1-naphthyloxy), a sulfoalkyl group (e.g., 2-sulfoethyl, 3-sulfopropyl, 3-sulfobutyl, 4-sulfobutyl, 2-(3-sulfopropoxy)ethyl, 2-hydroxy-3-sulfopropyl or 3-sulfopropoxyethoxyethyl), a sulfatoalkyl group (e.g., 3-sulfatopropyl or 4-sulfatobutyl), an arylthioalkyl group (e.g., phenylthioethyl), a heterocycle-substituted alkyl group (e.g., 2-(pyrrolidine-2-one-1-yl) ethyl, tetrahydrofurfuryl or 2-morpholinoethyl), 2-acetoxyethyl, carbomethoxymethyl or 2-methanesulfonylaminoethyl.

$R^2$, $R^4$ and $R^6$ are each more preferably an unsubstituted carboxyalkyl group having 5 or less carbon atoms (e.g., carboxymethyl, carboxyethyl, carboxypropyl or carboxybutyl), and particularly preferably carboxymethyl.

$V^1$, $V^2$, $V^3$, $V^4$, $V^5$, $V^6$, $V^7$, $V^8$, $V^9$ and $V^{10}$ each represents a hydrogen atom or a substituent. The substituents include substituent group V described above.

Although $V^1$ to $V^2$ are each preferably a hydrogen atom, an alkyl group, a halogen atom, an alkoxyl group or aryl group, particularly preferred is the case that $V^1$ to $V^7$ and $V^{10}$ are each hydrogen atom and $V^8$ and $V^9$ are each an alkyl group.

$L^1$, $L^2$, $L^3$, $L^4$ , $L^5$, $L^6$, $L^7$, $L^8$, $L^9$, $L^{10}$, $L^{11}$ and $L^{12}$ each represents an unsubstituted methine group or a substituted methine group (e.g., a methine group substituted by an unsubstituted or substituted alkyl group(e.g.,methyl, ethyl or 2-carboxyethyl), an unsubstituted or substituted aryl group (e.g., phenyl or 2-carboxyphenyl), a heterocyclic group (e.g., thienyl or barbituric acid group), a halogen atom (chlorine or bromine), an alkoxyl group (e.g., methoxyorethoxy), an amino group (e.g., N,N-diphenylamino, N-methyl-N-phenylamino or N-methylpiperazino) or an alkylthio group (e.g., methylthio or ethylthio)), and may form a ring with another methine group or with an auxochrome (for example, $L^1$ can form a ring with $R^1$).

$L^3$, $L^7$ and $L^{11}$ are each preferably an unsubstituted methine group or a methine group substituted by an alkyl group (e.g., methyl), an alkoxyl group (e.g., methoxy), an amino group (e.g., N-diphenyl amino) or a halogen atom (e.g., chlorine), of substituted methine groups. Particularly preferred is a methine group substituted by methyl.

$L^1$, $L^2$, $L^4$, $L^5$, $L^6$, $L^8$, $L^9$, $L^{10}$ and $L^{12}$ are each preferably an unsubstituted methine group.

As a combination of $L^1$, $L^2$, $L^3$ and $L^4$, particularly preferred is the case that $L^1$, $L^2$ and $L^4$ are each an unsubstituted methine group and $L^3$ is a methine group substituted by methyl.

As a combination of $L^5$, $L^6$, $L^7$ and $L^8$, particularly preferred is the case that $L^5$, $L^6$ and $L^8$ are each an unsubstituted methine group and $L^7$ is a methine group substituted by methyl.

As a combination of $L^9$, $L^{10}$, $L^{11}$ and $L^{12}$, particularly preferred is the case that $L^9$, $L^{10}$ and $L^{12}$ are each an unsubstituted methine group and $L^{11}$ is a methine group substituted by methyl.

$(M^1)m^1$, $(M^2)m^2$ and $(M^3)m^3$ are contained in the formulas for indicating the presence or absence of a cation or an anion when it is necessary for neutralizing an ion charge of a dye. It depends on an auxochrome or a substituent thereof whether a given dye is a cation or an anion, or whether it has a net ion charge or not. Examples of the typical cation include a hydrogen ion, an inorganic ammonium ion, an organic ammonium ion (e.g., a tetraalkylammonium ion, a pyridinium ion, a triethylamine salt or a 1,8-diazabicyclo[5,4,0]-7-undecene salt), an alkali metal ion (e.g., a sodium ion or a potassium ion), or an alkaline earth metal ion (e.g., a calcium ion). On the other hand, the anion may be specifically either an inorganic anion oranorganic anion, and examples thereof include, for example, a halogen anion (e.g., a fluoride ion, a chloride ion, a bromide ion or an iodide ion), a substituted arylsulfonic acid ion (e.g., p-toluenesulfonic acid ion or p-chlorobenzenesulfonic acid ion), an aryldisulfonic acid ion (e.g., a 1,3-benzenedisulfonic acid ion, a 1,5-naphthalenedisulfonic acid ion or a 2,6-naphthalenedisulfonic acid ion), an alkylsulfuric acid ion (e.g., methylsulfuric acid ion), a sulfuric acid ion, a thiocyanic acid ion, a perchloric acid ion, a tetrafluoroboric acid ion, a picric acid ion, an acetic acid ion and a trifluoromethanesulfonic acid ion. As a charge balancing counter ion, an ionic polymer or another dye having a reverse charge to a dye may be used, or a metal complex ion (e.g., bisbenzene-1,2-dithiolato nickel (III)) is available. Preferred are a hydrogen ion, an ammonium ion (e.g., a triethylamine salt or a 1,8-diazabicyclo-[5,4,0]-7-undecene salt) and an alkali metal ion (e.g., a sodium ion or a potassium ion), and particularly preferred are a hydrogen ion, a sodium ion, a potassium ion and a triethylamine salt.

Typical examples of the merocyanine dyes represented by formula (I) include but are not limited to the following:

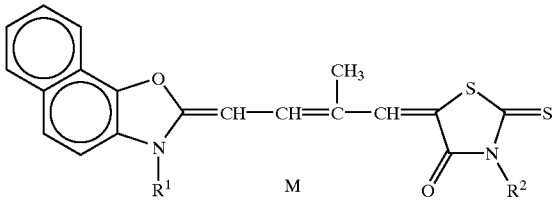

| No. | $R^1$ | $R^2$ | M |
|---|---|---|---|
| 1 | $C_2H_5$ | $CH_2COOH$ | — |
| 2 | n-$C_5H_{11}$ | $CH_2COOH$ | — |
| 3 | $C_2H_5$ | $(CH_2)_2SO_3^-$ | $Na^+$ |
| 4 | n-$C_8H_{17}$ | $CH_2COOH$ | — |
| 5 | n-$C_8H_{17}$ | $CH_2COO^-$ | $^+HN(C_2H_5)_3$ |
| 6 | n-$C_8H_{17}$ | $CH_2COO^-$ | $Na^+$ |
| 7 | n-$C_8H_{17}$ | $(CH_2)_2COOH$ | — |
| 8 | n-$C_5H_{11}$ | $(CH_2)_3SO_3^-$ | $Na^+$ |
| 9 | $(CH_2)_4SO_3^-$ | $CH_2COOH$ | $^+HN(C_2H_5)_3$ |
| 10 | $(CH_2)_4SO_3H$ | $CH_2COOH$ | — |
| 11 | $(CH_2)_3SO_3^-$ | $CH_2CO_2^-$ | $2Na^+$ |
| 12 | $(CH_2)_2SO_3^-$ | $CH_2CO_2^-$ | $^+2HN(C_2H_5)_3$ |
| 13 | $(CH_2)_3COOH$ | $CH_2COOH$ | — |
| 14 | $(CH_2)_4SO_3^-$ | $CH_2CO_2^-$ | $^+2HN(C_2H_5)_3$ |
| 15 | n-$C_8H_{17}$ | $C_2H_5$ | — |

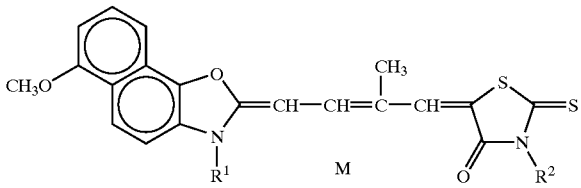

| No. | $R^1$ | $R^2$ | M |
|---|---|---|---|
| 16 | n-$C_8H_{17}$ | $CH_2COOH$ | — |
| 17 | n-$C_5H_{11}$ | $CH_2COO^-$ | $^+HN(C_2H_5)_3$ |
| 18 | $(CH_2)_3SO_3^-$ | $CH_2COOH$ | $Na^+$ |
| 19 | $C_2H_5$ | $CH_2COOH$ | — |

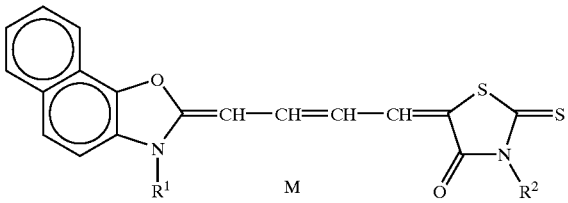

| No. | $R^1$ | $R^2$ | M |
|---|---|---|---|
| 20 | $(CH_2)_3SO_3^-$ | $CH_2COOH$ | $Na^+$ |
| 21 | n-$C_8H_{17}$ | $CH_2COOH$ | — |
| 22 | $C_2H_5$ | $CH_2COOH$ | — |

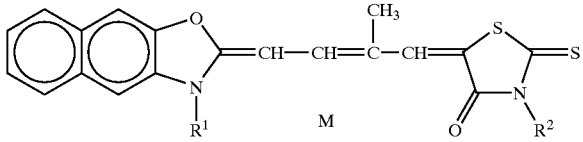

| No. | $R^1$ | $R^2$ | M |
|---|---|---|---|
| 23 | n-$C_8H_{17}$ | $CH_2COOH$ | — |

-continued

| No. | $R^1$ | $R^2$ | M |
|---|---|---|---|
| 24 | $C_2H_5$ | $CH_2COOH$ | — |
| 25 | $(CH_2)_4SO_3^-$ | $CH_2COOH$ | $^+HN(C_2H_5)_3$ |

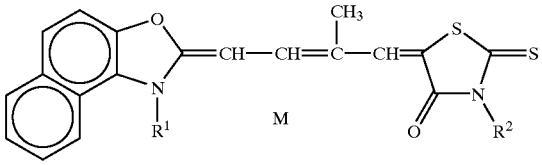

| No. | $R^1$ | $R^2$ | M |
|---|---|---|---|
| 26 | $CH_3$ | $CH_2COOH$ | — |
| 27 | $C_2H_5$ | $CH_2COOH$ | — |
| 28 | $(CH_2)_3SO_3^-$ | $CH_2COOH$ | $Na^+$ |

Typical examples of the merocyanine dyes represented by formula (III) include but are not limited to the following:

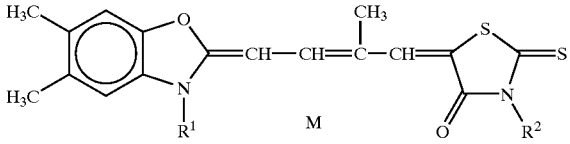

| No. | $R^1$ | $R^2$ | M |
|---|---|---|---|
| 29 | $C_2H_5$ | $CH_2COOH$ | — |
| 30 | n-$C_8H_{17}$ | $CH_2COOH$ | — |
| 31 | n-$C_8H_{17}$ | $CH_2COO^-$ | $^+HN(C_2H_5)_3$ |
| 32 | n-$C_8H_{17}$ | $CH_2COO^-$ | $Na^+$ |
| 33 | n-$C_8H_{17}$ | $(CH_2)_3SO_3^-$ | $Na^+$ |
| 34 | $(CH_2)_4SO_3^-$ | $CH_2COOH$ | $^+HN(C_2H_5)_3$ |

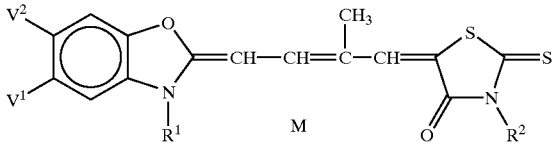

| No. | $V^1$ | $V^2$ | $R^1$ | $R^2$ | M |
|---|---|---|---|---|---|
| 35 | H | H | n-$C_8H_{17}$ | $CH_2COOH$ | — |
| 36 | Cl | H | n-$C_8H_{17}$ | $CH_2COOH$ | — |
| 37 | H | H | $C_2H_5$ | $CH_2COOH$ | — |
| 38 | p-$BrC_6H_4$— | H | n-$C_8H_{17}$ | $CH_2COO^-$ | $^+HN(C_2H_5)_3$ |
| 39 | $OCH_3$ | $OCH_3$ | $C_2H_5$ | $(CH_2)_2COOH$ | — |

The merocyanine dyes represented by formulas (I) to (III) which are used in the present invention can be synthesized based on methods described in the following literatures:

a) F. M. Hamer, *Heterocyclic Compounds—Cyanine dyes and related compounds-*, John Wiley & Sons, New York, London, 1964;

b) D. M. Sturmer, *Heterocyclic Compounds—Special topics in heterocyclic chemistry-*, chapter 8, section 4, pages 482 to 515, John Wiley & Sons, New York, London, 1977; and c) *Rodds Chemistry of Carbon Compounds,* (2nd ed., vol. IV, part B, 1977), chapter 15, pages 369 to 422; (2nd ed., vol. IV, part B, 1985), chapter 15, pages 267 to 296, Elsevier Science Publishing Company Inc., New York.

A method for synthesizing themerocyanine dyes represented by formulas (I) and (II) will be described below by reference to a specific example.

Synthesis Example: Synthesis of Compound 4

2-Methylnaphtho[2,1-d]oxazole (2.4 g) and 3.5 ml of n-octyl iodide were stirred at 160° C. for 6 hours, and then, 7 ml of acetic anhydride and 7 g of 1,1,3,3-tetraethoxy-2-methylpropane were added thereto, followed by stirring at 100° C. for 1 hour. The mixture was allowed to cool to room temperature, and ethyl acetate and hexane were added thereto. Then, 2.6 g of a solid 2-(4-ethoxy-3-methyl-1,3-butadienyl)-3-octyl-naphtho[2,1-d]oxazolium iodide salt thus produced was corrected by filtration. This solid (2.5 g) and 0.96 g of 3-carboxymethylrhodanine were dissolved in 10 ml of acetonitrile, and 2.1 ml of triethylamine was added thereto. After the reaction solution was stirred at room temperature for 1 hour, 1 ml of acetic acid was added thereto, and the resulting crude crystals were corrected by filtration. These crude crystals were recrystallized from methanol to obtain 2.1 g of compound 4.

$\lambda$ max(MeOH)=591 nm, $\in$=1.04×10$^5$ (MeOH), melting point: 258 to 260° C.

Other compounds of the present invention can also be synthesized by methods similar to the above-described Synthesis Example.

The merocyanine dyes represented by formulas (I) and (II) of the present invention may be used in a desired amount, providing a match to characteristics such as sensitivity and fog. However, they are used preferably in an amount of $10^{-6}$ mol to 1 mol, and more preferably in an amount of $10^{-4}$ mol to $10^{-1}$ mol, per mol of silver halide of a light-sensitive layer.

As the sensitizing dyes in the present invention, dyes having structures other than the structures represented by formulas (I) and (II) may be used in combination with the dyes represented by formulas (I) and (II). Particularly preferred dyes which can be used in combination are the merocyanine dyes represented by formula (III). Further, a plurality of dyes can also be used as a mixture to obtain a desired spectral sensitization spectrum.

The mixing ratio of the merocyanine dyes represented by formulas (I) and (II) to the merocyanine dyes represented by formula (III) may be any. However, it is preferably within the range of 1:10 to 10:1, and particularly preferably within the range of 1:2 to 2:1, in the molar ratio.

These sensitizing dyes may be used alone or as a combination of two or more of them. Combinations of the sensitizing dyes are of ten used particularly for supersensitization. Emulsions may contain dyes having no spectral sensitizing function for themselves, or substances which do not substantially absorb visible light and exhibit supersensitization, together with the sensitizing dyes. The useful sensitizing dyes, the combinations of the dyes showing supersensitization, and the substances exhibiting supersensitization are described in *Research Disclosure,* 176, 17643, p.23, item IV-J, (December, 1978) or JP-B-49-25500 (the term "JP-B" as used herein means an "examined Japanese patent publication"), JP-B-43-4933, JP-A-59-19032 (the term "JP-A" as used herein means an "unexamined published Japanese patent application") and JP-A-59-192242.

When the sensitizing dyes are added to the silver halide emulsions, they may be directly dispersed in the emulsions, or may be dissolved in single or mixed solvents of water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol and N,N-dimethylformamide to add them to the emulsions as solutions.

Further, methods which can be used in the present invention include a method of dissolving a dye in a volatile organic solvent, dispersing the resulting solution into water or a hydrophilic colloid, and adding the resulting dispersion to an emulsion, as described in U.S. Pat. No. 3,469,987; a method of dissolving a dye in an acid, and adding the resulting solution to an emulsion, or dissolving a dye in water in the presence of an acid or a base, and adding the resulting aqueous solution to an emulsion, as described in JP-B-44-23389, JP-B-44-27555 and JP-B-57-22091; a method of dissolving or dispersing a dye into water in the presence of a surfactant, and adding the resulting aqueous solution or colloidal dispersion to an emulsion, as described in U.S. Pat. Nos. 3,822,135 and 4,006,025; a method of directly dispersing a dye into a hydrophilic colloid, and adding the resulting dispersion to an emulsion, as described in JP-A-53-102733 and JP-A-58-105141; and a method of dissolving a dye by the use of a red-shifting compound, and adding the resulting solution to an emulsion, as described in JP-A-51-74624. Further, ultrasonic waves can also be applied to the solution.

The sensitizing dyes used in the present invention may be added at any stages of the preparation of the silver halide emulsions which have hitherto been accepted to be useful. For example, they may be added at a silver halide grain formation stage and/or before desalting, during a silver-removing stage and/or from after desalting to before the start of chemical ripening, as described in U.S. Pat. Nos. 2,735,766, 3,628,960, 4,183,756 and 4,225,666, JP-A-58-184142 and JP-A-60-196749, or at any time and stage before the coating of emulsions, such as immediately before or during chemical ripening, or from after chemical ripening to the coating of the emulsions, as described in JP-A-58-113920. Furthermore, as disclosed in U.S. Pat. No. 4,225,666 and JP-A-58-7629, the same compound maybe singly added, or in combination with a compound having a foreign structure, divided, for example, into during a grain formation stage and during or after chemical ripening, or before or during chemical ripening and after chemical ripening. The kinds of compounds added in parts and combinations thereof may be changed.

The organic silver salt which can be used in the present invention is relatively stable to light, and is a silver salt forming a silver image when heated to a temperature of 80° C. or more in the presence of an exposed photocatalyst (such as a latent image of a light-sensitive silver halide) and a reducing agent. The organic silver salt may be any organic substance containing a source which can reduce a silver ion. Such light-insensitive organic silver salts are described in JP-A-10-62899, paragraph numbers 0048 to 0049, EP-A-0803764, page 18, line 24 to page 19, line 37, and EP-A-0962812. Silver salts of organic acids, particularly silver salts of long-chain aliphatic carboxylic acids (each having from 10 to 30 carbon atoms, and preferably from 15 to 28 carbon atoms), are preferred. Preferred examples of the organic silver salts include silver behenate, silver arachidate, silver stearate, silver oleate, silver laurate, silver caproate, silver myristate, silver palmitate, and mixtures thereof. In the present invention, of these organic silver salts, an organic acid silver salt having a silver behenate content of 75 mol % or more is preferably used.

There is no particular limitation on the form of the organic silver salts which can be used in the present invention, and they may be acicular, rod-like, tabular or scaly.

In the present invention, scaly organic silver salts are preferred. In this specification, the term "scaly organic silver salt" is defined as follows. The organic acid silver salt is observed under an electron microscope, and the form of an organic acid silver salt particle is approximated to a rectangular parallelepiped. When the sides of this rectangular parallelepiped are taken as a, b and c from the shortest one (c may be equal to b), x is calculated by the following equation using shorter numerical values a and b:

$$X=b/a$$

x is determined in this manner for about 200 particles, and the average value thereof is taken as x (average). The particles satisfying the relationship of x (average)≧1.5 are defined as scaly particles. The relationship is preferably 30≧x (average)≧1.5, and more preferably 20≧x (average)≧2.0. By the way, when 1≦x (average) <1.5 is satisfied, the particles are defined as acicular particles.

In the scaly particle, a can be considered as the thickness of a tabular particle in which a plane having sides b and c is a main plane. The average of a is preferably from 0.01 μm to 0.23 μm, and more preferably from 0.1 μm to 0.20 μm. The average of c/b is preferably from 1 to 6, more preferably from 1.05 to 4, still more preferably from 1.1 to 3, and particularly preferably from 1.1 to 2.

It is preferred that the organic silver salt has monodisperse particle size distribution. The term "monodisperse" means that the percentage of a value of the standard deviation of each length of the short and long axes divided by each the short and long axes is preferably 100% or less, more preferably 80% or less, and still more preferably 50% or less. The form of the organic silver salt can be measured by an image of an organic silver salt dispersion observed under a transmission electron microscope. As another method for measuring the monodispersibility, there is a method of determining the standard deviation of volume weighted average diameters of the organic silver salt. The percentage (the coefficient of variation) of values divided by volume weighted average diameters is preferably 100% or less, more preferably 80% or less, and still more preferably 50% or less. This can be determined, for example, from particle sizes (volume weighted average diameters) determined by irradiating laser light to the organic silver salt dispersed in a solution and determining the auto correlation function to changes in fluctuation of its scattered light with time.

To methods for producing and dispersing the organic acid silver salts used in the present invention, well-known methods can be applied. For example, JP-A-10-62899, EP-A-0803763 and EP-A-0962812 described above can be referred to.

In the present invention, the coexistence of a light-sensitive silver salt at dispersing the organic silver salt results in an increase in fog and extreme decrease of sensitivity. Accordingly, it is more preferred that a light-sensitive silver salt is not substantially contained at dispersing the organic silver salt. In the present invention, the amount of the light-sensitive silver salt contained in an aqueous dispersion is preferably 0.1 mol % or less per mol of organic acid silver salt in the dispersion, and the light-sensitive silver salt is not positively added.

In the present invention, it is possible to produce the light-sensitive material by mixing the aqueous dispersion of the organic silver salt with the aqueous dispersion of the light-sensitive silver salt. The mixing ratio of the organic silver salt to the light-sensitive silver salt can be selected depending on the purpose. However, the ratio of the light-sensitive silver salt to the organic silver salt is preferably within the range of 1 mol % to 30 mol %, more preferably within the range of 3 mol % to 20 mol %, and particularly preferably within the range of 5 mol % to 15 mol %. In mixing, it is preferably used for adjusting the photographic characteristics that two or more kinds of aqueous dispersions of organic silver salts are mixed with two or more kinds of aqueous dispersions of light-sensitive silver salts.

In the present invention, the organic silver salts can be used in a desired amount. However, they are used preferably in an amount of 0.1 g/m$^2$ to 5 g/m$^2$, and more preferably in an amount of 1 g/m$^2$ to 3 g/m$^2$, in terms of silver.

It is preferred that the photothermographic materials of the present invention contain reducing agents for the organic silver salts. The reducing agents for the organic silver salts maybe any substances for reducing a silver ion to metallic silver (preferably organic substances). Such reducing agents are described in JP-A-11-65021, paragraph numbers 0043 to 0045, and EP-A-0803764, page 7, line 34 to page 18, line 12. In the present invention, bisphenol reducing agents (e.g., 1,1-bis(2-hydroxy-3,5-dimethylphenyl)-3,5,5-trimethylhexane), 2,2'-methylenebis-(4-methyl-6-tert-butylphenol) and 2,2'-ethylenebis-(4-methyl-6-tert-butylphenol) are particularly preferred. The amount of the reducing agents added is preferably from 0.01 g/m$^2$ to 5.0 g/m$^2$, and more preferably from 0.1 g/m$^2$ to 3.0 g/m$^2$. They are contained preferably in an amount of 5 mol % to 50 mol %, and more preferably in an amount of 10 mol % to 40 mol %, per mol of silver of a face having an image formation layer. The reducing agents are preferably contained in the image formation layers.

The reducing agents may be added to coating solutions by any methods such as solution methods, emulsified dispersion methods and fine solid particle dispersion methods, thereby allowing them to be contained in the light-sensitive materials.

The well-known emulsified dispersion methods include a method of dissolving the reducing agents using oils such as dibutyl phthalate, tricresyl phosphate, glyceryl triacetate, and diethylphthalate or co-solvents (i.e., auxiliary solvents) such as ethyl acetate and cyclohexanone, and mechanically preparing emulsified dispersions.

Further, the fine solid particle dispersion methods include a method of dispersing reducing agent powder in appropriate solvents such as water by a ball mill, a colloid mill, a vibrating ball mill, a sand mill, a jet mill or a roller mill, or by a supersonic wave to prepare solid dispersions. In that case, protective colloids (e.g., polyvinyl alcohol) and surfactants (e.g., anionic surfactants such as sodium triisopropylnaphthalenesulfonate (a mixture of three isomers different in substitution positions of isopropyl groups) may be used. The aqueous dispersion may contain preservatives (e.g., benzoisothiazolinone sodium salt).

In the photothermographic materials of invention, phenol derivatives represented by formula (A) described in JP-A-267222/2000 are preferably used as development accelerators.

There is no particular limitation on the composition of the light-sensitive silver halides used in the present invention, and silver chloride, silver chlorobromide, silver bromide, silver iodobromide and silver iodochlorobromide can be used. The distribution of the halogen composition in the grain may be uniform, or the halogen composition may vary stepwise or continuously. Further, silver halide grains having the core/shell structure can be preferably used. Double to five fold structure type core/shell grains can be preferably used, and double to fourfold structure type core/shell grains can be more preferably used. Furthermore, a process of localizing silver bromide on the surfaces of silver chloride or silver chlorobromide grains can also preferably used.

Methods for forming the light-sensitive silver halides are well-known in the art. For example, methods described in *Research Disclosure,* vol. 17029 (June, 1978) and U.S. Pat. No. 3,700,458 can be used. Specifically, a method of adding a silver supplying compound and a halogen supplying compound to a gelatin solution or another polymer solution to prepare light-sensitive silver halide grains (silver halide emulsion), and then, mixing the resulting silver halide grains with an organic silver salt is used.

Also, methods described in JP-A-11-119374(paragraph numbers 0217-0224), JP-A-11-352627 and JP-A-347335/2000 can be preferably used.

For inhibiting white turbidity after image formation, it is preferred that the grain size of the light-sensitive silver halide is small. Specifically, the grain size is preferably 0.20 $\mu$m or less, more preferably from 0.01 $\mu$m to 0.15 $\mu$m, and still more preferably from 0.02 $\mu$m to 0.12 $\mu$m. The term "grain size" as used herein means the diameter of a sphere having the same volume as that of the silver halide grain, when the silver halide grain is a normal (i.e., regular) crystal such as a cube or octahedron, and is not a normal crystal, such as a spherical or rod-like grain. When the silver halide grain is a tabular grain, the grains size means the diameter of a circle image having the same area as a projected area of a main surface.

The form of the silver halide grains may be cubic, octahedral, tabular, spherical, rod-like or pebble-like. In the present invention, however, cubic grains are particularly preferred. Silver halide grain shaving rounded corners can also be preferably used. There is no particular limitation on the surface index (mirror index) of outer surfaces of the light-sensitive silver halide grains. However, it is preferred that the ratio of the [100] face having high spectral sensitization efficiency when a spectral sensitizing dye is adsorbed thereby is high. The ratio is preferably 50% or more, more preferably 65% or more, and most preferably 80% or more. The ratio of the mirror index [100] face can be determined by a method described in T. Tani, J., *Imaging Sci.,* 29, 165 (1985), utilizing adsorption dependency of the [111] face and the [100] face in adsorption of a sensitizing dye.

The light-sensitive silver halide grains of the present invention contain metals or metal complexes of groups VIII to X in the periodic table (showing groups I to XVIII). The metals or central metals of the metal complexes of groups VIII to X in the periodic table are rhodium, ruthenium and iridium. These metal complexes may be used either alone or as a combination of two or more of complexes comprising the same kind or foreign kinds of metals. The content thereof is preferably from $1\times10^{-9}$ mol to $1\times10^{-3}$ mol per mol of silver. These heavy metals, metal complexes and methods for adding them are described in JP-A-7-225449, JP-A-11-65021, paragraph numbers 0018 to 0024, and JP-A-11-119374, paragraph numbers 0227 to 0240.

Of these, the iridium compounds are preferably contained in the silver halide grains in the present invention. Examples of the iridium compounds include, for example, hexachloroiridium, hexaammineiridium, trioxalatoiridium and hexacyanoiridium. These iridium compounds are used by dissolving them in water or appropriate solvents. In order to stabilize the solution of the iridium compound, a method ordinarily frequently used, that is to say, a method of adding an aqueous solution of a hydrogen halide (e.g., hydrochloric acid, hydrobromic acid or hydrofluoric acid) or an alkali halide (e.g., KCl, NaCl, KBr or NaBr), which is generally frequently used, can be used. Instead of use of the water-soluble iridium, it is also possible to add and dissolve other silver halide grains previously doped with iridium in preparing the silver halide. These iridium compounds are added preferably in an amount ranging from $1\times10^{-8}$ mol to $1\times10^{-3}$ mol, and more preferably in an amount ranging from $1\times10^{-7}$ mol to $5\times10^{-4}$ mol, per mol of silver halide.

Further, metal atoms which can be contained in the silver halide grains used in the present invention (e.g., $[Fe(CN)_6]^{4-}$), desalting methods and chemical sensitizing methods are described in JP-A-11-84574, paragraph numbers 0046 to 0050, JP-A-11-65021, paragraph numbers 0025 to 0031, and JP-A-11-119374, paragraph number 0242 to 0250.

As gelatins contained in the light-sensitive silver halide emulsions (silver halide emulsions containing the light-sensitive silver halides) used in the present invention, there can be used various kinds of gelatins. In order to keep good the dispersing state of the light-sensitive silver halide emulsions inorganic silver salt-containing coating solutions, it is preferred that low molecular weight gelatins having a molecular weight of 500 to 60,000 are used. Although these low molecular weight gelatins may be used at forming the grains, or at dispersing the grains after desalting, they are preferably used at dispersing the grains after desalting.

As the sensitizing dyes applicable to the present invention, there can be selected sensitizing dyes which can spectrally sensitize the silver halide grains in adesired wavelength region when adsorbed by the silver halide grains, and which have spectral sensitivity suitable for the spectral characteristics of an exposure light source. The sensitizing dyes and methods for adding them are described in JP-A-11-65021, paragraph numbers 0103 to 0109, JP-A-10-186572 (compounds represented by formula (II)), JP-A-11-119374 (dyes represented by formula (I) and paragraph number 0106), U.S. Pat. Nos. 5,510,236 and 3,871,887 (dyes described in Example 5), JP-A-2-96131, JP-A-59-48753 (dyes described therein) and EP-A-0803764, page 19, line 38 to page 20, line 35. These sensitizing dyes may be used either alone or as a combination of two or more of them. In the present invention, the sensitizing dyes are added to the silver halide emulsions preferably from after desalting to coating, and more preferably from after desalting to before the start of chemical ripening.

In the present invention, the sensitizing dyes may be used in a desired amount depending on performances such as sensitivity and fog. However, they are used preferably in an amount of $10^{-6}$ mol to 1 mol, and more preferably in an amount of $10^{-4}$ mol to $10^{-1}$ mol, per mol of silver halide of the light-sensitive layer.

In the present invention, for improving spectral sensitization efficiency, supersensitizing agents can be used. The supersensitizing agents used in the present invention include compounds described in EP-A-587,338, U.S. Pat. Nos. 3,877,943 and 4,873,184, JP-A-5-341432, JP-A-11-109547 and JP-A-10-111542.

It is preferred that the light-sensitive silver halide grains contained in the silver halide emulsions in the present invention are chemically sensitized by sulfur sensitization, selenium sensitization or tellurium sensitization. As compounds preferably used for sulfur sensitization, selenium sensitization and tellurium sensitization, there can be used well-known compounds, for example, compounds described in JP-A-7-128768. In particular, tellurium sensitizers are preferably used in the present invention, and more preferred are compounds described in literatures described in JP-A-11-65021, paragraph number 0030, and compounds represented by formulas (II), (III) and (IV) in JP-A-5-313284.

In the present invention, chemical sensitization is possible at any time, such as (1) before spectral sensitization, (2) concurrently with spectral sensitization, (3) after spectral sensitization or (4) immediately before coating, after desalting, as long as it is conducted after grain formation and before coating. In particular, chemical sensitization is preferably conducted after spectral sensitization.

The amount of sulfur, selenium and tellurium sensitizers used in the present invention is from $1\times10^{-8}$ mol to $1\times10^{-2}$ mol, and preferably from about $1\times10^{-7}$ mol to about $1\times10^{-3}$ mol, per mol of silver halide, although it varies depending on silver halide grains used and chemical ripening conditions. There is no particular limitation on the conditions of chemical sensitization in the present invention. However, the pH is from 5 to 8, the pAg is from 6 to 11, and the temperature is from about 40° C. to about 95° C.

Thiosulfonic acid compounds may be added to the silver halide emulsions used in the present invention by a method shown in EP-A-293,917.

The light-sensitive silver halide emulsions in the light-sensitive materials used in the present invention may be used either alone or as a combination of two or more of them (for example, emulsions different in mean grain size, emulsions different in halogen composition, emulsions different in crystal habit, and emulsions different in the conditions of chemical sensitization). The use of plural kinds of light-sensitive silver halides different in sensitivity allows the gradation to be controlled. Techniques relating to these are described in JP-A-57-119341, JP-A-53-106125, JP-A-47-3929, JP-A-48-55730, JP-A-46-5187, JP-A-50-73627 and JP-A-57-150841. As to the difference in sensitivity, a difference of 0.21 logE or more is preferably given between the respective emulsions.

The amount of the light-sensitive silver halides added is preferably from 0.03 g/m$^2$ to 0.6 g/m$^2$, more preferably from 0.05 g/m$^2$ to 0.4 g/m$^2$, and most preferably from 0.1 g/m$^2$ to 0.4 g/m$^2$, in terms of the amount of silver coated per m$^2$ of light-sensitive material. It is preferably from 0.01 mol to 0.5 mol, and more preferably from 0.02 mol to 0.3 mol, per mol of organic silver salt.

As processes for mixing the light-sensitive silver halides and the organic silver salts separately prepared and mixing conditions thereof, there are a method of mixing the separately prepared silver halide grains and organic silver salt with each other in a high-speed stirrer, a ball mill, a sand mill, a colloid mill, a vibrating mill or a homogenizer, and a method of mixing the prepared light-sensitive silver halide at any timing during preparation of the organic silver salt to prepare the organic silver salt. However, there is no particular limitation thereon, as long as the effects of the present invention are sufficiently manifested. Further, in mixing, it is a preferred method for adjustment of photographic characteristics that two or more kinds of aqueous dispersions of the organic silver salts are mixed with two or more kinds of aqueous dispersions of the light-sensitive silver salts.

The silver halides used in the present invention are preferably added to the coating solutions for image forming layers from 180 minutes before coating to immediately before coating, preferably from 60 minutes before coating to 10 seconds before coating. However, there is no particular limitation on the mixing process and the mixing conditions, as long as the effects of the present invention are sufficiently manifested. Specific examples of the mixing processes include a mixing process using a tank designed so that the average residence time calculated from the flow rate of the solution added and the amount of the solution supplied to a coater becomes a desired time, and a process using static mixers described in N. Harnby, M. F. Edwards and A. W. Nienow, translated by Koji Takahashi, *Liquid Mixing Techniques,* chapter 8, published by Nikkan Kogyo Shinbunsha (1989).

Binders for the organic silver salt-containing layers may be any polymers, and suitable binders are transparent or translucent and generally colorless. They are natural and synthetic resins (polymers and copolymers) and other film forming media, and examples thereof include gelatin, gum arabic, poly (vinyl alcohol), hydroxyethyl cellulose, cellulose acetate, cellulose acetate butylate, poly (vinylpyrrolidone), casein, starch, poly(acrylic acid), poly (methyl methacrylate), poly(vinyl chloride), poly (methacrylic acid), styrene-maleic anhydride copolymers, styrene-acrylonitrile copolymers, styrene-butadiene copolymers, poly(vinyl acetal) polymers (e.g., poly (vinyl formal) and poly (vinyl butyral)), polyesters polyurethanes, phenoxy resins, poly(vinylidene chloride), polyepoxides, polycarbonates, poly(vinyl acetate), cellulose esters and polyamides. The binders may be formed from aqueous solutions, organic solvent solutions or emulsions by coating.

In the present invention, it is preferred that the organic silver salt-containing layer is formed by applying a coating solution in which 30% by weight or more of a solvent is water, followed by drying, and further it is preferred that the binder of the organic silver salt-containing layer is soluble or dispersible in an aqueous solvent (water solvent) and particularly is composed of a polymer latex having an equilibrium moisture content of 2% by weight or less at 25° C., 60% RH. The most preferred form is one prepared so as to give an ionic conductivity of 2.5 mS/cm or less, and as the methods, a method of purifying the polymer with a separation functional membrane after synthesis thereof are exemplified.

The term "an aqueous solvent in which the polymer is soluble or dispersible" as used herein means water or a mixture of water and 70% by weight or less of a water-soluble or aqueous-miscible organic solvent. Examples of the aqueous-miscible organic solvents include, for example, alcohols such as methyl alcohol, ethyl alcohol and propyl alcohol, cellosolve derivatives such as methyl cellosolve, ethyl cellosolve and butyl cellosolve, ethyl acetate and dimethylformamide.

When the polymer is not dissolved thermodynamically to exist in a so-called dispersion state, the term "aqueous solvent" is also used herein.

The term "equilibrium moisture content at 25° C., 60% RH" as used herein can be expressed using the weight W1 of a polymer attaining equilibrium with moisture in the atmosphere of 25° C. and 60% RH and the weight W0 of the polymer in the absolute dry condition at 25° C. as follows:

$$\text{Equilibrium Moisture Content at 25° C., 60\% RH}=[(W1-W0)/W0]\times100\ (\%\text{ by weight})$$

For the definition of the moisture content and the measuring method thereof, reference can be made to *Polymer Engineering Course,* 14, "Test Methods of Polymer Materials" (edited by Kobunshi Gakkai, Chijin Shokan).

The equilibrium moisture content of the binder polymers of the present invention at 25° C., 60% RH is preferably 2% by weight or less, more preferably from 0.01% to 1.5% by weight, and still more preferably from 0.02% to 1% by weight.

In the present invention, polymers dispersible in the aqueous solvents are particularly preferred. Examples of the dispersion states include latexes in which fine particles of water-insoluble hydrophobic polymers are dispersed, and dispersions of polymer molecules dispersed in a molecular state or forming micelles, both of which are preferred. The mean particle size of the dispersed particles is from about 1 nm to about 50,000 nm, and more preferably from about 5 nm to about 1,000 nm. There is no particular limitation on the particle size distribution of the dispersed particles. The particles may be either ones having a wide particle size distribution or ones having a monodisperse particle size distribution.

In the present invention, preferred examples of the polymers dispersible in the aqueous solvents include hydrophobic polymers such as acrylic resins, polyester resins, rubber resins (e.g., SBR resins), polyurethane resins, vinyl chloride resins, vinyl acetate resins, vinylidene chloride resins and polyolefin resins. The polymer may be a straight chain polymer, a branched polymer or a crosslinked polymer. Further, the polymer may be either a so-called homopolymer in which a single monomer is polymerized, or a copolymer in which two or more kinds of monomers are polymerized. The copolymer may be either a random copolymer or a block copolymer. The number average molecular weight of the polymer is preferably from 5,000 to 1,000,000, and more preferably from about 10,000 to about 200,000. Too low a molecular weight unfavorably results in insufficient mechanical strength of the emulsion layer, whereas too high a molecular weight causes poor film forming properties.

Preferred examples of the polymer latexes include the following, wherein the polymers are represented by raw material monomers, the numerals in parentheses are percentages by weight, and the molecular weight is the number average molecular weight.

P-1: Latex of -MMA(70)-EA(27)-MAA(3)-(molecular weight: 37,000);

P-2: Latex of -MMA(70)-2EHA(20)-St(5)-AA(5)-(molecular weight: 40,000);

P-3: Latex of -St(50)-Bu(47)-MAA(3)-(molecular weight: 45,000);

P-4: Latex of -St(68)-Bu(29)-AA(3)-(molecular weight: 60,000);

P-5: Latex of -St(70)-Bu(27)-IA(3)-(molecular weight: 120,000)

P-6: Latex of -St(75)-Bu(24)-AA(1)-(molecular weight: 108,000);

P-7: Latex of -St(60)-Bu(35)-DVB(3)-MAA(2)-(molecular weight: 150,000);

P-8: Latex of -St(70)-Bu(25)-DVB(2)-AA(3)-(molecular weight: 280,000);

P-9: Latex of -VC(50)-MMA(20)-EA(20)-AN(5)-AA(5)-(molecular weight: 80,000);

P-10: Latex of -VDC(85)-MMA(5)-EA(5)-MAA(5)-(molecular weight: 67,000);

P-11: Latex of -Et(90)-MMA(10)-(molecular weight: 12,000);

P-12: Latex of -St(70)-2EHA(27)-AA(3) (molecular weight: 130,000); and

P-13: Latex of -MMA(63)-EA(35)-AA(2) (molecular weight: 33,000).

Abbreviations used in the above-described structures indicate the following monomers:

MMA; Methyl methacrylate, EA; Ethyl acrylate, MAA; Methacrylic acid, 2EHA; 2-Ethylhexyl acrylate, St; Styrene, Bu; Butadiene, AA; Acrylic acid, DVB; Divinylbenzene, VC; Vinyl chloride, AN; Acrylonitrile, VDC; Vinylidene chloride, Et: Ethylene and IA; Itaconic acid The polymers described above are commercially available, and the following polymers can be utilized. Examples of the acrylic resins include Sebian A-4635, 46583 and 4601 (the above products are manufactured by Daicel Chemical Industries, Ltd.) and Nipol Lx 811, 814, 821, 820 and 857 (the above products are manufactured by Nippon Zeon Co., Ltd), examples of the polyester resins include FINETEXES 650, 611, 675 and 850 (the above products are manufactured by Dainippon Ink & Chemicals, Inc.), and WD-size and WMS (the above products are manufactured by Eastman Chemical Co.), examples of the polyurethane resins include HYDRAN AP 10, 20, 30 and 40 (the above products are manufactured by Dainippon Ink & Chemicals, Inc.), examples of the rubber resins include LACSTAR 7310K, 3307B, 4700H and 7132C (the above products are manufactured by Dainippon Ink & Chemicals, Inc.) and Nipol Lx 416, 410, 438C and 2507 (the above products are manufactured by Nippon Zeon Co., Ltd.), examples of the vinyl chloride resins include G351 and G576 (the above products are manufactured by Nippon Zeon Co., Ltd.), examples of the vinylidene chloride resins include L502 and L513 (the above products are manufactured by Asahi Chemical Industry Co., Ltd.), and examples of the polyolefin resins include Chemipearl S120 and SA100 (the above products are manufactured by Mitsui Petrochemical Industries, Ltd.).

These polymer latexes may be used either alone or as a mixture of two or more of them as required.

As the polymer latexes used in the present invention, styrene-butadiene copolymer latexes are particularly preferred. In the styrene-butadiene copolymer latex, the weight ratio of styrene monomer units to butadiene monomer units is preferably from 40:60 to 95:5. Further, the ratio of the styrene monomer units and the butadiene monomer units to the copolymer is preferably from 60% to 99% by weight. The preferred molecular weight range is the same as described above.

The styrene-butadiene copolymer latexes which can be preferably used in the present invention include P-3 to P-8 described above and commercially available LACSTAR-3307B, 7132C and Nipol Lx416.

The organic silver salt-containing layer of the light-sensitive material of the present invention may further contain a hydrophilic polymer such as gelatin, polyvinyl alcohol, methyl cellulose, hydroxypropyl cellulose or carboxymethyl cellulose. The amount of the hydrophilic polymer added is preferably 30% by weight or less, and more preferably 20% by weight or less, base on the total binder of the organic silver salt-containing layer.

The organic silver salt-containing layer (that is to say, the image formation layer) of the present invention is preferably formed using the polymer latex, and as the amount of binder contained in the organic silver salt-containing layer, the weight ratio of total binder/silver halide is preferably from 1/10 to 10/1, and more preferably from 1/5 to 4/1.

Further, such an organic silver salt-containing layer is also usually a light-sensitive layer (emulsion layer) containing the light-sensitive silver halide that is the light-sensitive silver salt. In such a case, the weight ratio of total binder/silver halide is preferably from 400 to 5, and more preferably from 200 to 10.

The total binder amount of the image formation layer of the present invention is preferably from 0.2 $g/m^2$ to 30 $g/m^2$, and more preferably from 1 $g/m^2$ to 15 $g/m^2$. The image formation layer of the present invention may contain a crosslinking agent for crosslinking and a surfactant for improving coating properties.

In the present invention, the solvent (both the solvent and the dispersing medium are referred to as the solvent herein for brevity) for a coating solution for the organic silver salt-containing layer of the light-sensitive material is an aqueous solvent containing water in an amount of 30% by weight or more. As components other than water, any water-miscible organic solvents such as methyl alcohol, ethyl alcohol, isopropyl alcohol, methyl cellosolve, ethyl cellosolve, dimethylformamide and ethyl acetate may be used. The water content of the solvents of the coating solutions is preferably 50% by weight or more, and more preferably 70% by weight or more. Preferred examples of solvent compositions include water/methyl alcohol=90/10, water/methyl alcohol=70/30, water/methyl alcohol/dimethylformamide=80/15/5, water/methyl alcohol/ethyl cellosolve=85/10/5 and water/methyl alcohol/isopropyl alcohol=85/10/5 (wherein the numeral values are percentages by weight), as well as water.

Antifoggants, stabilizers and stabilizer precursors which can be used in the present invention include ones described in patents described in JP-A-10-62899, paragraph number 0070 and EP-A-0803764, page 20, line 57 to page 21, line 7. Further, antifoggants preferably used in the present invention are organic halides, which include ones disclosed in patents described in JP-A-11-65021, paragraph numbers 0111 to 0112. In particular, organic halogen compounds represented by formula (P) of JP-A-284399/2000 and organic polyhalogen compounds represented by formula (II) of JP-A-10-339934 (specifically, tribromomethylnaphthylsulfone, tribromomethylphenylsulfone and tribromomethyl(4-(2,4,6-trimethylphenylsulfonyl) phenyl)sulfone) are preferred.

Methods for adding the antifoggants of the present invention to the light-sensitive materials of the present invention include the above-described methods for adding the reducing agents. The organic polyhalogen compounds are preferably added as fine solid particle dispersions.

Other antifoggants include mercury (II) salts described in JP-A-11-65021, paragraph number 0113, benzoic acid derivatives described in JP-A-11-65021, paragraph number 0114, salicylic acid derivatives represented by formula (Z) of JP-A-284399/2000 and formalin scavengers represented by formula (S) of JP-A-221634/2000.

In the present invention, the photothermographic materials may contain azolium salts for the purpose of fog prevention. The azolium salts include compounds represented by formula (XI) described in JP-A-59-193447, compounds described in JP-B-55-12581, and compounds represented by formula (II) described in JP-A-60-153039. Although the azolium salt may be added to any site of the light-sensitive material, it is preferably added to a layer on a side having the light-sensitive layer. More preferably, it is added to the organic silver salt-containing layer. The azolium salt may be added at any stage of the preparation of the coating solution. When added to the organic silver salt-containing layer, the azolium salt may be added at any stage from the preparation of the organic silver salt to the preparation of the coating solution, preferably from after the preparation of the organic silver salt to immediately before coating. The azolium salt may be added in any form such as a powder, a solution or a fine particle dispersion. Further, the azolium salt may be added as another solution in which it is mixed with an additive such as a sensitizing dye, a reducing agent or a color toning agent. In the present invention, the azolium salt may be added in any amount, but preferably in an amount of $1\times10^{-6}$ mol to 2 mol, more preferably $1\times10^{-3}$ mol to 0.5 mol, per mol of silver.

In the present invention, mercapto compounds, disulfide compounds or thione compounds can be added for inhibiting or accelerating development, improving the spectral sensitizing efficiency and improving shelf life (i.e., storage stability) before and after development. Such compounds are described in JP-A-10-62899, paragraph numbers 0067 to 0069, Jl?-A-10-186572 (compounds represented by formula (I) and specific examples described in paragraph numbers 0033 to 0052), EP-A-0803764, page 20, lines 36 to 56 and Japanese Patent Application No. 11-273670. Of these, mercapto-substituted heteroaromatic compounds are preferred.

In the present invention, phosphoryl group-containing compounds are preferably used, and phosphine oxides are particularly preferred. Specific examples thereof include triphenylphosphine oxide, tri -(4-methylphenyl)phosphine oxide, tri-(4-methoxyphenyl)phosphine oxide, tri-(t-butylphenyl)phosphine oxide and tri-(3-methylphenyl) phosphine oxide and trioctylphosphine oxide. The phosphoryl group-containing compounds of the present invention can be introduced into the light-sensitive materials in the same manner as in the reducing agents and the polyhalogen compounds. The phosphoryl group-containing compounds of the present invention are added preferably at a ratio (molar ratio) of 0.1 to 10, more preferably 0.1 to 2.0, still more preferably 0.2 to 1.0, based on the reducing agent.

Color toning agents are preferably added to the photothermographic materials of the present invention. The color toning agents are described in JP-A-10-62899, paragraph numbers 0054 to 0055, EP-A-0803764, page 21, lines 23 to 48 and JP-A-35631/2000. Preferred are phthalazinone, phthalazinone derivatives and metal salts thereof, or derivatives of 4-(1-naphthyl)phthalazinone, 6-chlorophthalazinone, 5,7-dimethoxyphthalazinone and 2,3-dihydro-1,4-phthalazinedione; combinations of phthalazinone and phthalic acid derivatives (e.g., phthalic acid, 4-methylphthalic acid, 4-nitrophthalic acid and tetrachlorophthalic acid anhydride); phthalazines (phthalazine, phthalazine derivatives or metal salts thereof, or derivatives of 4-(1-naphthyl)phthalazine, 6-isopropylphthalazine, 6-t-butylphthalazine, 6-chlorophthalazine, 5,7-dimethoxyphthalazine and 2,3-dihydrophthalazine); and combinations of phthalazines and phthalic acid derivatives (e.g., phthalic acid, 4-methylphthalic acid, 4-nitrophthalic acid and tetrachlorophthalic acid anhydride). Combinations of phthalazines and phthalic acid derivatives are particularly preferred.

Plasticizers and lubricants which can be used in the light-sensitive layers are described in JP-A-11-65021, paragraph number 0117, and super contrast-increasing agents for formation of super high contrast images are described in JP-A-11-65021, paragraph number 0118, JP-A-11-223898, paragraph numbers 0136 to 0193, JP-A-284399/2000 (compounds of formulas (H), (1) to (3), (A) and (B)) and JP-A-347345/2000 (compounds of formulas (III) to (V), specific compounds: "compounds 21 to 24"). Contrast-increasing accelerators are described in JP-A-11-65021, paragraph number 0102, and JP-A-11-223898, paragraph numbers 0194 to 0195. Methods for adding nucleating agents and the amount thereof are described in JP-A-11-223898, paragraph numbers 0182 to 0183.

For using formic acid or a formate as a strong foggant, it is added to a side having a light-sensitive silver halide-containing image formation layer preferably in an amount of 5 mmol or less, and more preferably in an amount of 1 mmol or less, per mol of silver.

When the nucleating agents are used in the photothermographic materials of the present invention, acids produced by hydration of diphosphorus pentaoxide or salts thereof are preferably used in combination therewith. The acids produced by hydration of diphosphorus pentaoxide or the salts thereof include metaphosphoric acid and salts thereof, pyrophosphoric acid and salts thereof, orthophosphoric acid and salts thereof, triphosphoric acid and salts thereof, tetraphosphoric acid and salts thereof, and hexametaphosphoric acid and salts thereof. Particularly preferred are orthophosphoric acid and salts thereof, and hexametaphosphoric acid and salts thereof. Specific examples of the salts are sodium orthophosphate, sodium dihydrogenorthophosphate, sodium hexametaphosphate and ammonium hexametaphosphate.

The acids produced by hydration of diphosphorus pentaoxide or the salts thereof may be used in a desired amount depending on performances such as sensitivity and fog. However, the amount thereof used (the amount thereof coated per $m^2$ of light-sensitive material) is preferably from 0.1 $mg/m^2$ to 500 $mg/m^2$, and more preferably from 0.5 $mg/m^2$ to 100 $mg/m^2$.

The photothermographic material of the present invention may be provided with a surface protective layer for preventing adhesion of the image formation layer. The surface protective layers are described in JP-A-11-65021, paragraph numbers 0119 to 0120.

As a binder for the surface protective layer of the present invention, gelatin is preferred. However, the use of polyvinyl alcohol (PVA) is also preferred. Examples of the PVA includes PVA-105 (a completely saponified product), PVA-205 and PVA-335 (partially saponified products), and MP-203 (modified polyvinyl alcohol: the above names are names of commercial products manufactured by Kuraray Co., Ltd.). The amount of polyvinyl alcohol coated (per $m^2$ of support) for every one protective layer is preferably from 0.3 $mg/m^2$ to 4.0 $mg/m^2$, and more preferably from 0.3 $mg/m^2$ to 2.0 $mg/m^2$.

In particular, when the photothermographic material of the present invention is used for application in printing in which changes in dimension cause trouble, it is preferred that a polymer latex is also used in the protective layer or a back layer. Such polymer latexes are described in *Synthetic Resin Emulsions,* edited by Taira Okuda and Hiroshi Inagaki, published by Kobunshi Kankokai (1978), *Application of Synthetic Latexes,* edited by Takaaki Sugimura, Yasuo Kataoka, Soichi Suzuki and Keiji Kasahara, published by Kobunshi Kankokai (1993) and Soichi Muroi, *Chemistry of Synthetic Latexes,* published by Kobunshi Kankokai (1970), and specific examples thereof include a methyl methacrylate (33.5% by weight)/ethyl acrylate (50% by weight)/methacrylic acid (16.5% by weight) copolymer latex, a methyl methacrylate (47.5% by weight)/butadiene (47.5% by weight)/itaconic acid (5% by weight) copolymer latex, an ethyl acrylate/methacrylic acid copolymer latex, a methyl methacrylate (58.9% by weight)/2-ethylhexyl acrylate (25.4% by weight)/styrene (8.6% by weight)/2-hydroxyethyl methacrylate (5.1% by weight)/acrylic acid (2.0% by weight) copolymer latex, and a methyl methacrylate (64.0% by weight)/styrene (9.0% by weight)/butyl acrylate (20.0% by weight)/2-hydroxyethyl methacrylate (5.0% by weight)/acrylic acid (2.0% by weight) copolymer latex. Further, as the binders for the protective layers, there may be applied combinations of polymer latexes described in EP1020760A, techniques described in JP-A-267226/2000, paragraph numbers 0021 to 0025, techniques described in EP1020760A, paragraph numbers 0027 to 0028, and techniques described in JP-A-19678/2000, paragraph numbers 0023 to 0041. The ratio of the polymer latex of the protective layer is preferably from 10% by weight to 90% by weight, and more preferably from 20% by weight to 80% by weight, based on the total binder.

The amount of the total binder (including a water-soluble polymer and the polymer latex) coated (per $m^2$ of support) for every one protective layer is preferably from 0.3 $mg/m^2$ to 5.0 $mg/m^2$, and more preferably from 0.3 $mg/m^2$ to 2.0 $mg/m^2$.

The preparation temperature of the coating solutions for the image formation layers used in the present invention is preferably from 30° C. to 65° C., more preferably from 35° C. to less than 60° C., and still more preferably from 35° C. to 55° C. Further, the temperature of the coating solutions for the image formation layers immediately after addition of the polymer latexes is preferably maintained at a temperature of 30° C. to 65° C. Furthermore, it is preferred that the reducing agents and the organic silver salts are mixed before addition of the polymer latexes.

The organic silver salt-containing fluids or the coating solutions for the image formation layers used in the present invention are preferably so-called thixotropic fluids. The thixotropy means the property that the viscosity decreases with an increase in the shear rate. Although any instruments may be used for measurement of the viscosity in the present invention, an RFS fluid spectrometer manufactured by Rheometrics Far East Co., Ltd., is preferably used and measurements are made at 25° C. Here, for the organic silver salt-containing fluids or the coating solutions for the image formation layers used in the present invention, the viscosity at a shear rate of 0.1 $S^{-1}$ is preferably from 400 mPa·s to 100,000 mPa·s, and more preferably from 500 mPa·s to 20,000 mPa·s. Further, the viscosity at a shear rate of 1,000 $S^{-1}$ is preferably from 1 mPa·s to 200 mPa·s, and more preferably from 5 mPa·s to 80 mPa·s.

Various kinds of systems exhibiting the thixotropy are known, and described in *Course Rheology,* edited by Kobunshi Kankokai, and Muroi and Morino, *Polymer Latexes* (published by Kobunshi Kankokai. For allowing fluids to exhibit the thixotropy, they are required to contain many fine solid particles. Further, for enhancing the thixotropy, it is effective to contain thickening linear polymers, to increase the aspect ratio by the anisotropic form of the fine solid particles contained, and to use alkali thickening agents and surfactants.

The photothermographic emulsion of the present invention is applied onto a support as one or more layers. For the single layer structure, the layer is required to contain the organic silver salt, the silver halide, a developing agent and the binder, and optionally, additional materials such as the color toning agent, an auxiliary coating agent (i.e., a coating aid) and other auxiliary agents. For the two-layer structure, a first emulsion layer (usually, a layer adjacent to the substrate) is required to contain the organic silver salt and the silver halide, and a second layer or both layers must contain some other components. However, a single emulsion layer containing all components and the two-layer structure comprising a protective top coat is also conceivable. The structure of a multicolor-sensitive photothermographic material may contain a combination of these two layers for each color, or all components in a single layer as described in U.S. Pat. No. 4,708,928. In the case of a multi-dye multicolor-sensitive photothermographic material, respective emulsion layers are generally kept distinguished from each other by using a functional or nonfunctional barrier layer between respective light-sensitive layers, as described in U.S. Pat. No. 4,460,681.

The light-sensitive layers used in the present invention can contain various kinds of dyes and pigments (e.g., C.I.

Pigment Blue 60, C.I. Pigment Blue 64 and C.I. Pigment Blue 15:6) from the viewpoint of improvement in a color tone, prevention of the occurrence of interference fringes and prevention of irradiation. These are described in detail in WO98/36322, JP-A-10-268465 and JP-A-11-338098.

In the photothermographic material of the present invention, an antihalation layer can be provided on the side far away from a light source with respect to the light-sensitive layer.

The photothermographic materials generally have light-insensitive layers, in addition to the light-sensitive layers. The light-insensitive layers can be classified into four types: (1) a protective layer provided on the light-sensitive layer (on the side far away from the support), (2) an intermediate layer provided between the plural light-sensitive layers or between the light-sensitive layer and the protective layer, (3) an undercoat layer provided between the light-sensitive layer and the support, and (4) a back layer provided on the side opposite to the light-sensitive layer. The light-sensitive layer is provided with a filter layer as the layer of (1) or (2), and with an antihalation layer as the layer of (3) or (4).

The antihalation layers are described in JP-A-11-65021, paragraph numbers 0123 to 0124, JP-A-11-223898, JP-A-9-230531, JP-A-10-36695, JP-A-10-104779, JP-A-11-231457, JP-A-11-352625 and JP-A-11-352626.

The antihalation layer contains an antihalation dye having absorption at an exposure wavelength. When the exposure wavelength is in the infrared region, an infrared absorption dye is used, and in that case, a dye having no absorption in the visible region is preferably used.

When halation is prevented by using a dye having absorption in the visible region, it is preferred that the color of the dye does not substantially remain after image formation. For that purpose, a means of decoloring the dye by heat of heat development is preferably used, and particularly, it is preferred that a heat decoloring agent and a base precursor are added to the light-insensitive layer to allow it to act as an antihalation layer. These techniques are described in JP-A-11-231457.

The amount of the decoloring dyes added is determined depending on their purpose. In general, they are used in such an amount that an optical density (absorbance) exceeding 0.1 is given when measured at a desired wavelength. The optical density is preferably from 0.2 to 2. The amount of the dyes used for obtaining such optical density is generally from about 0.001 g/m$^2$ to about 1 g/m$^2$.

Such decoloring of the dyes allows the optical density after heat development to decrease to 0.1 or less. Two or more kinds of decoloring dyes may be used together in heat decoloring type recording materials or the photothermographic materials. Similarly, two or more kinds of base precursors may be used together.

In heat decoloring using such decoloring dyes and base precursors, it is preferred in terms of heat decoloring properties that they are used in combination with substances (e.g., diphenyl sulfone and 4-chlorophenyl(phenyl)sulfone) decreasing the melting point by 3° C. or more by mixing with the base precursors as described in JP-A-11-352626.

In the present invention, for improving the variation of silver tone images with the elapse of time, a coloring agent having the absorption maximum at 300 nm to 450 nm can be added. Such coloring agents are described in JP-A-62-210458, JP-A-63-104046, JP-A-63-103235, JP-A-63-208846, JP-A-63-306436, JP-A-63-314535, JP-A-01-61745 and Japanese Patent Application No. 11-276751.

Such a coloring agents are usually added in an amount ranging from 0.1 mg/m$^2$ to 1 g/m$^2$, and preferably added to a back layer provided on the side opposite to the light-sensitive layer.

It is preferred that the photothermographic material of the present invention is a so-called single-sided light-sensitive material having at least one silver halide emulsion-containing light-sensitive layer on one side of the support and the back layer on the other side.

In the present invention, a matte agent is preferably added for improving the transferring properties. The matte agents are described in JP-A-11-65021, paragraph numbers 0126 to 0127. When indicated by the amount coated per m$^2$ of light-sensitive material, the amount of the matte agent coated is preferably from 1 mg/m$^2$ to 400 mg/m$^2$, and more preferably from 5 mg/m$^2$ to 300 mg/m$^2$.

The matte degree of an emulsion surface may be any, as long as no white-spot unevenness occurs. However, the Bekk's smoothness is preferably from 30 seconds to 2,000 seconds, and particularly preferably from 40 seconds to 1,500 seconds. The Bekk's smoothness can be easily determined by the Japanese Industrial Standard (JIS) P8119, "Smoothness Test Method of Paper and Paperboard with BeKk's Tester" and the TAPPI Standard T479.

In the present invention, the Bekk's smoothness of the back layer is preferably from 10 seconds to 1,200 seconds, more preferably from 20 seconds to 800 seconds, and still more preferably from 40 seconds to 500 seconds.

In the present invention, the matte agent is preferably contained in the outermost surface layer, a layer which functions as the outermost layer, or a layer close to the outer surface, of the light-sensitive material, and preferably contained in a layer which functions as the so-called protective layer.

The back layers applicable to the present invention are described in JP-A-11-65021, paragraph numbers 0128 to 0130.

In the photothermographic materials of the present invention, the film surface pH before heat development processing is preferably 6.0 or less, and more preferably 5.5 or less. Although there is no particular limitation on the lower limit thereof, it is about 3. It is preferred from the viewpoint of reducing the film surface pH that the film surface pH is adjusted with organic acids such as phthalic acid derivatives, nonvolatile acids such as sulfuric acid, or volatile bases such as ammonia. In particular, ammonia is volatile and removable before the coating stage or heat development, so that it is preferred in that the low film surface pH is achieved. A method for measuring the film surface pH is described in JP-A-284399/2000.

A hardener may be used in each layer of the light-sensitive layer, the protective layer and the back layer of the present invention. Examples of the hardeners are described in T. H. James, *THE THEORY OF THE PHOTOGRAPHIC PROCESS FOURTH EDITION,* pages 77 to 87, published by Macmillan Publishing Co., Inc. (1977), and multivalent metal ions described in ibid., page 78, polyisocyanates described in U.S. Pat. No. 4,281,060 and JP-A-6-208193, epoxy compounds described in U.S. Pat. No. 4,791,042 and vinylsulfone compounds described in JP-A-62-89048 are preferably used.

The hardeners are added as solutions, and the solutions are preferably added to the coating solutions for image forming layers from 180 minutes before coating to immediately before coating, preferably from 60 minutes before coating to 10 seconds before coating. However, there is no particular limitation on the mixing process and the mixing conditions, as long as the effects of the present invention are sufficiently manifested. Specific examples of the mixing processes include a mixing process using a tank designed so that the average residence time calculated from the flow rate of the solution added and the amount of the solution supplied to a coater becomes a desired time, and a process using static mixers described in N. Harnby, M. F. Edwards and A. W. Nienow, translated by Koji Takahashi, *Liquid Mixing Techniques,* chapter 8, published by Nikkan Kogyo Shinbunsha (1989).

Surfactants applicable to the present invention are described in JP-A-11-65021, paragraph number 0132, solvents in the same, paragraph number 0133, supports in the same, paragraph number 0134, antistatic or conductive layers in the same, paragraph number 0135, methods for obtaining color images in the same, paragraph number 0136, and lubricants (i.e., sliding agents)in JP-A-11-84573, paragraph numbers 0061 to 0064 and EP1045284A, paragraph numbers 0049 to 0062.

As transparent supports, there are preferably used polyester films, particularly polyethylene terephthalate films subjected to heat treatment within the temperature range of 130° C. to 185° C. for relaxing internal strain remaining in the films at biaxial stretching to remove heat shrinkage strain generated in heat development processing. In the case of photothermographic materials for medical application, the transparent supports may be either colored with blue dyes (for example, dye-1 described in the example of JP-A-8-240877), or not colored. It is preferred that undercoating techniques of water-soluble polyesters described in JP-A-11-84574, styrene-butadiene copolymers described in JP-A-10-186565 and vinylidene chloride copolymers described in EP1045284A, paragraph numbers 0063 to 0080 are applied to the supports. Further, techniques described in JP-A-56-143430, JP-A-56-143431, JP-A-58-62646, JP-A-56-120519, JP-A-11-84573, paragraph numbers 0040 to 0051, U.S. Pat. No. 5,575,957 andJP-A-11-223898, paragraph numbers 0078 to 0084 can be applied to the antistatic layers and undercoating.

The photothermographic materials are preferably of a mono-sheet type (a type in which images can be formed on the photothermographic materials without the use of other sheets, such as image receiving materials).

Anti-oxidizing agents, stabilizers, plasticizers, ultraviolet absorbers and coating aids may be further added to the photo thermographic materials. Various additives are added to either the light-sensitive layers or the light-insensitive layers. For these additives, reference can be made to WO98/36322, EP-A-803764, JP-A-10-186567 and JP-A-10-18568.

The photothermographic materials of the present invention may be applied by any methods. Specifically, various coating operations including extrusion coating, slide coating, curtain coating, dip coating, knife coating, flow coating and extrusion coating using a hopper described in U.S. Pat. No. 2,681,294 are used. Extrusion coating described in Stephen F. Kistler and Petert M. Schweizer, *LIQUID FILM COATING,* pages 399 to 536, published by CHAPMAN & HALL (1997) or slide coating is preferably used, and slide coating is particularly preferably used. Examples of the shapes of slide coaters used in slide coating are shown in ibid., FIG. 11*b.* on page 427. Two or more layers can be formed at the same time by methods described in ibid., pages 399 to 536, U.S. Pat. No. 2,761,791 and GB-837,095, as so desired.

Techniques which can be used in the photothermographic materials of the present invention are also described in EP-A-803764, EP-A-883022, WO98/36322, JP-A-56-62648, JP-A-58-62644, JP-A-9-281637, JP-A-9-297367, JP-A-9-304869, JP-A-9-311405, JP-A-9-329865, JP-A-10-10669, JP-A-10-62899, JP-A-10-69023, JP-A-10-186568, JP-A-10-90823, JP-A-10-171063, JP-A-10-186565, JP-A-10-186567, JP-A-10-186569 to JP-A-10-186572, JP-A-10-197974, JP-A-10-197982, JP-A-10-197983, JP-A-10-197985 to JP-A-10-197987, JP-A-10-207001, JP-A-10-207004, JP-A-10-221807, JP-A-10-282601, JP-A-10-288823, JPA-10-288824, JP-A-10-307365, JP-A-10-312038, JP-A-10-339934, JP-A-11-7100, JP-A-11-15105, JP-A-11-24200, JP-A-11-24201, JP-A-11-30832, JP-A-11-84574, JP-A-11-65021, JP-A-11-109547, JP-A-11-125880, JP-A-11-129629, JP-A-11-133536 to JP-A-11-133539, JP-A-11-133542, JP-A-11-133543 and JP-A-11-223898.

Although the photothermographic materials of the present invention may be developed by any methods, the photothermographic materials exposed imagewise are usually developed by elevating the temperature thereof. The developing temperature is preferably from 80° C. to 250° C., and more preferably from 100° C. to 140° C. The developing time is preferably from 1 second to 180 seconds, more preferably from 10 seconds to 90 seconds, and particularly preferably from 10 second to 40 seconds.

As the heat development system, a plate heater system is preferred, and as the heat development system according to the plate heater system, a method described in JP-A-11-133572 is preferred. In this method, a heat development apparatus giving visible images by contacting the photothermographic material having latent images formed with a heating means in a heat development unit is used, wherein the heating means comprises a plate heater, a plurality of press rollers are arranged along one side of the plate heater, facing thereto, and the photothermographic material is allowed to pass between the press rollers and the plate heater to conduct heat development. It is preferred that the plate heater is divided into 2 to 6 steps and the temperature is decreased by about 1° C. to about 10° C. at a leading edge portion thereof. Such a method is also described in JP-A-54-30032, and water and an organic solvent contained in the photothermographic material can be removed outside the system. Further, changes in the support form of the photothermographic material caused by rapid heating thereof can also be inhibited.

Although the light-sensitive materials of the present invention may be exposed by any methods, laser light is preferably used as an exposure light source. Preferred examples of the lasers used in the present invention include a gas laser (Ar+ or He—Ne), a YAG laser, a dye laser and a semiconductor laser. Further, a semiconductor laser and a second harmonic generating element can also be used in combination. Preferred is a red- to infrared-emitting gas laser or a semiconductor laser.

Laser imagers for medical application provided with exposure units and heat development units include a Fuji medical dry laser imager, FM-DPL. FM-DPL is described in *Fuji Medical Review,* No.8, pages 39 to 55, and needless to say, this technique can be applied as the laser imager for the photothermographic material of the present invention. Further, this can also be applied as the photothermographic material for the laser imager in an "AD network" proposed by Fuji Medical System as a network system adapted to the DICOM standard.

The photothermographic materials of the present invention form black and white images according to silver images, and preferably used as photothermographic materials for medical diagnosis, photothermographic materials for industrial photography, photothermographic materials for printing and photothermographic materials for COM.

The present invention will be described in more detail with reference to the following examples, but it is to be understood that the present invention is not limited to these examples.

EXAMPLE 1

(Preparation of PET Support)

Using terephthalic acid and ethylene glycol, PET having an IV (i.e., an intrinsic viscosity) of 0.66 (measured in phenol/tetrachloroethane (6/4 in weight ratio) at 25° C.) was obtained. This was pelletized, and dried at 130° C. for 4 hours. Then, this was melted at 300° C., and extruded through a T die, followed by rapid cooling to prepare an unoriented film having such a thickness as to give a film thickness of 175 μm after heat setting.

This unoriented film was oriented lengthwise 3.3 times by use of rolls different from each other in peripheral speed, and then, oriented crosswise 4.5 times with a tenter. At this time, the temperatures were 110° C. and 130° C., respectively. Then, the oriented film was heat set at 240° C. for 20 seconds, and there after relaxed crosswise by 4% at the same temperature. Then, after portions chucked with the tenter were slit off, the knurl treatment was applied to both edges. Then, the resulting film was wound up at a tension of 4 kg/cm$^2$ to obtain a roll of the film having a thickness of 175 μm.

(Surface Corona Treatment)

Both surfaces of the support were treated with a Model 6KVA solid state corona treating device manufactured by Piller Co., Ltd., at room temperature at 20 m/min. Readings of current and voltage at this time revealed that the support was treated at 0.375 kV·A·min./m$^2$. The treatment frequency at this time was 9.6 kHz, and the gap clearance between an electrode and a dielectric roll was 1.6 mm.

(Preparation of Undercoated Support)

(1) Preparation of Coating Solutions for Undercoat Layers

| Formulation (for Undercoat Layer on Light-Sensitive Layer Side) | |
|---|---|
| Pesresin A-515GB manufactured by Takamatsu Yushi Co., Ltd. (a 30-wt % solution) | 234 g |
| Polyethylene glycol monononyl phenyl ether (average ethylene oxide number: 8.5, a 10-wt % solution) | 21.5 g |
| MP-1000 manufactured by Soken Chemical & Engineering Co., Ltd. (fine polymer particles, average particle size: 0.4 μm) | 0.91 g |
| Distilled water | 744 ml |
| **Formulation (for First Layer on Back Face Side)** | |
| Butadiene-styrene copolymer latex (solid content: 40 wt %, butadiene/styrene weight ratio: 32/68) | 158 g |
| 2,4-Dichloro-6-hydroxy-S-triazine sodium salt (a 8-wt % aqueous solution) | 20 g |
| A 1-wt % aqueous solution of sodium laurylbenzenesulfonate | 10 ml |
| Distilled water | 854 ml |
| **Formulation (for Second Layer on Back Face Side)** | |
| $SnO_2$/SbO (weight ratio: 9/1, average particle size: 0.038 μm, a 17-wt % dispersion) | 84 g |
| Gelatin (a 10% aqueous solution) | 89.2 g |
| Metrose TC-5 manufactured by Shin-Etsu Chemical Co., Ltd. (a 2% aqueous solution) | 8.6 g |
| MP-1000 manufactured by Soken Chemical & Engineering Co., (fine polymer particles) | 0.01 g |
| A 1-wt % aqueous solution of sodium dodecylbenzenesulfonate | 10 ml |
| NaOH (1%) | 6 ml |
| Proxel (manufactured by I.C.I) | 1 ml |
| Distilled water | 805 ml |

(2) Preparation of Undercoated Support

After the above-described corona discharge treatment was conducted to both faces of the 175-μm thick biaxially stretched polyethylene terephthalate support, one face (light-sensitive layer face) was coated with the coating solution for undercoat with a wire bar so as to give a wet amount coated of 6.6 ml/m$^2$ (per one face), and dried at 180° C. for 5 minutes. Then, the back face thereof was coated with the coating solution for undercoat with a wire bar so as to give a wet amount coated of 5.7 ml/m$^2$, and dried at 180° C. for 5 minutes. The back face was further coated with the coating solution for undercoat with a wire bar so as to give a wet amount coated of 7.7 ml/m$^2$, and dried at 180° C. for 6 minutes. Thus, an undercoated support was prepared.

(Preparation of Back Face Coating Solutions)

(Preparation of Fine Solid Particle Dispersion (a) of Base Precursor)

Base precursor compound 11 (64 g), 28 g of diphenyl sulfone and 10 g of a surfactant, Demol N manufactured by Kao Corp. were mixed with 220 ml of distilled water, and the mixed solution was subjected to beads dispersion using a sand mill (a ¼ gallon sand grinder mill, manufactured by Imex Co., Ltd.) to obtain a fine solid particle dispersion (a) of the base precursor compound having an average particle size of 0.2 μm.

(Preparation of Fine Solid Particle Dispersion of Dye)

Cyanine dye compound 13 (9.6 g) and 5.8 g of sodium p-dodecylbenzenesulfonate were mixed with 305 ml of distilled water, and the mixed solution was subjected to beads dispersion using a sand mill (a ¼ gallon sand grinder mill, manufactured by Imex Co., Ltd.) to obtain a fine solid particle dispersion of the dye having an average particle size of 0.2 μm.

(Preparation of Coating Solution for Antihalation Layer)

Gelatin (17 g), 9.6 g of polyacrylamide, 70 g of the above-described fine solid particle dispersion (a) of the base precursor, 56 g of the above-described fine solid particle dispersion of the dye, 1.5 g of fine polymethyl methacrylate particles (average particle size: 6.5 μm), 0.03 g of benzoisothiazolinone, 2.2 g of sodium polyethylenesulfonate, 0.2 g of blue dye compound 14, 3.9 g of yellow dye compound 15 and 844 ml of water were mixed to prepare a coating solution for an antihalation layer.

(Preparation of Coating Solution for Back Face Protective Layer)

A vessel was kept hot at 40° C., and 50 g of gelatin, 0.2 g of sodium polyethylenesulfonate, 2.4 g of N,N'-ethylene-bis(vinylsulfoneacetamide), 1 g of sodium t-octylphenoxyethoxyethanesulfonate, 30 mg of benzoisothiazolinone, 37 g of N-perfluorooctylsulfonyl-N-propylalanine potassium salt, 0.15 g of polyethylene glycol mono(N-perfluorooctylsulfonyl-N-propyl-2-aminoethyl) ether (average degree of ethylene oxide polymerization: 15), 32 mg of $C_8F_{17}SO_3K$, 64 mg of $C_8F_{17}SO_2N—(C_3H_7)(CH_2CH_2O)_4(CH_2)_4—SO_3Na$, 8.8 g of acrylic acid/ethyl acrylate copolymer (copolymerization weight ratio: 5/95), 0.6 g Aerosol OT (manufactured by American Cyanamide), 1.8 g of a fluid paraffin emulsion as fluid paraffin, and 950 ml of water were mixed therein to prepare a coating solution for a back face protective layer.

(Preparation of Silver Halide Emulsion 1)

To 1421 ml of distilled water, 3.1 ml of a 1 wt % potassium bromide solution was added, and 3.5 ml of 1 mol/L sulfuric acid and 31.7 g of phthalated gelatin were further added thereto. The resulting solution was maintained at 35° C. in a titanium-coated stainless steel reaction pot with stirring. On the other hand, solution A was prepared by diluting 22.22 g of silver nitrate with distilled water to make 95.4 ml, and solution B was prepared by diluting 15.9 g of potassium bromide with distilled water to make 97.4 ml. Solution A and solution B were wholly added at a constant flow rate for 45 seconds. Then, 10 ml of a 3.5 wt % aqueous solution of hydrogen peroxide was added, and 10.8 ml of a 10 wt % aqueous solution of benzimidazole was further added. Furthermore, solution C was prepared by diluting 51.86 g of silver nitrate with distilled water to make 317.5 ml, and solution D was prepared by diluting 45.8 g of potassium bromide with distilled water to make 400 ml. Solution C was wholly added at a constant flow rate for 20 minutes, and solution D was added by the control double jet method, while maintaining the pAg at 8.1. Then, potassium iridate (III) hexachloride was wholly added so as to give $1\times10^{-4}$ mol per mol of silver, 10 minutes after the start of addition of solution C and solution D. Further, 5 seconds after the termination of addition of solution C, an aqueous solution of potassium iron (II) hexacyanide was wholly added in an amount of $3\times10^{-4}$ mol per mol of silver. The pH was adjusted to 3.8 using 0.5 mol/L sulfuric acid, and stirring was stopped, followedby sedimentation, desalting and washing. Then, the pH was adjusted to 5.9 with 1 mol/L sodium hydroxide to prepare a silver halide dispersion having a pAg of 8.0.

The above-described silver halide dispersion was maintained at 38° C. with stirring, and 5 ml of a 0.34 wt % methanol solution of 1,2-benzoisothiazoline-3-one was added thereto. After 40 minutes, a solution of spectral sensitizing dye 30 in methanol was added in an amount of $1\times10^{-3}$ mol per mol of silver, and after 1 minute, the temperature was elevated to 47° C. Twenty minutes after the temperature elevation, sodium benzenethiosulfonate was added in an amount of $7.6\times10^{-5}$ mol per mol of silver as a methanol solution, and after further 5 minutes, tellurium sensitizer B was added in an amount of $1.9\times10^{-4}$ mol per mol of silver as a methanol solution, followed by ripening for 91 minutes. Then, 1.3 ml of a 0.8 wt % solution of N,N'-dihydroxy-N"-diethylmelamine in methanol was added.

After still further 4 minutes, 5-methyl-2-mercaptobenzimidazole was added in an amount of $3.7\times10^{-3}$ mol per mol of silver as a methanol solution, and 1-phenyl-2-heptyl-5-mercapto-1,3,4-trazole was added in an amount of $4.9\times10^{-3}$ mol per mol of silver as a methanol solution. Thus, silver halide emulsion 1 was prepared.

Grains in the resulting silver halide emulsion were pure silver bromide grains having an average sphere corresponding diameter (i.e., an average equivalent sphere diameter) of 0.046 $\mu$m and a coefficient of variation of sphere corresponding diameters of 20%. The grain size was determined from an average of 1000 grains using an electron microscope. The [100] face ratio of the grains determined by the Kubelka-Munk method was 85%.

(Preparation of Silver Halide Emulsion 2)

Silver halide emulsion 2 was prepared in the same manner as in the preparation of silver halide emulsion 1 with the exception that the liquid temperature in forming the grains was changed from 34° C. to 49° C., the addition time of solution C was changed to 30 minutes, and potassium iron (II) hexacyanide was removed. Similarly to silver halide emulsion 1, precipitation/desalting/washing/dispersion were carried out.

Further, spectral sensitization, chemical sensitization and addition of 5-methyl-2-mercaptobenzimidazole and 1-phenyl-2-heptyl-5-mercapto-1,3,4-trazole were conducted in the same manner as in the preparation of silver halide emulsion 1 with the exception that the amount of spectral sensitizing dye 30 added was changed to $7.5\times10^{-4}$ mol per mol of silver, the amount of tellurium sensitizer B added was changed to $1\times10^{-4}$ mol per mol of silver, and the amount of 1-phenyl-2-heptyl-5-mercapto-1,3,4-trazole added was changed to $3.3\times10^{-3}$mol per mol of silver. Thus, silver halide emulsion 2 was obtained. Emulsion grains of silver halide emulsion 2 were cubic pure silver bromide grains having an average sphere corresponding diameter (i.e., an average equivalent sphere diameter) of 0.080 $\mu$m and a coefficient of variation of sphere corresponding diameters of 20%.

(Preparation of Silver Halide Emulsion 3)

Silver halide emulsion 3 was prepared in the same manner as in the preparation of silver halide emulsion 1 with the exception that the liquid temperature in forming the grains was changed from 34° C. to 27° C. Similarly to silver halide emulsion 1, precipitation/desalting/washing/dispersion were carried out. Silver halide emulsion 3 was obtained in the same manner as in the preparation of emulsion 1 with the exception that the amount of a solid dispersion (aqueous solution of gelatin) of spectral sensitizing dye 30 added was changed to $6\times10^{-3}$ Mol per mol of silver, and the amount of tellurium sensitizer B added was changed to $5.2\times10^{-4}$ Mol per mol of silver. Emulsion grains of silver halide emulsion 3 were cubic pure silver bromide grains having an average sphere corresponding diameter of 0.038 $\mu$m and a coefficient of variation of sphere corresponding diameters of 20%.

(Preparation of Mixed Emulsion for Coating Solution)

Silver halide emulsion 1 (70% by weight), 15% (by weight) of silver halide emulsion 2 and 15% (by weight) of silver halide emulsion 3 were dissolved, and benzothiazolium iodide was added thereto as a 1 wt % aqueous solution in an amount of $7\times10^{-3}$ mol per mol of silver.

(Preparation of Scaly Fatty Acid Silver Salt)

Behenic acid (trade name: Edenor C22-85R) (87.6 kg) manufactured by Henckel Co., Ltd., 423 L of distilled water, 49.2 L of a 5 N aqueous solution of NaOH and 120 L of tert-butanol were mixed, and stirred at 75° C. for 1 hour to conduct the reaction, thereby obtaining a sodium behenate solution. Separately, 206.2 L of an aqueous solution containing 40.4 kg of silver nitrate (pH 4.0) was prepared, and the temperature thereof was kept at 10° C. A reaction vessel in which 635 L of distilled water and 30 L of tert-butanol were placed was kept at a temperature of 30° C., and the sodium behenate solution previously prepared and the aqueous solution of silver nitrate were wholly added thereto at a constant flow rate for 62 minutes and 10 seconds and for 60 minutes, respectively. At this time, only the aqueous solution of silver nitrate was added for 7 minutes and 20 seconds after the start of addition of the aqueous solution of silver nitrate. Thereafter, addition of the sodium behenate solution was started, and only the sodium behenate solution was added for 9 minute and 30 seconds after addition of the aqueous solution of silver nitrate was completed. At this time, the temperature in the reaction vessel was adjusted to 30° C., and the temperature of the outside was controlled so that the liquid temperature was maintained constant. Further, a pipe of an addition system of the sodium behenate solution was lagged with steam jacket, and the opening degree of a valve for steam was controlled so that the liquid temperature at an outlet of a tip of an addition nozzle became 75° C. Further, a pipe of an addition system of the aqueous solution of silver nitrate was lagged with circulating cool water in the outer space of a double pipe. A position of adding the sodium behenate solution and a position of adding the aqueous solution of silver nitrate were arranged symmetrically centered on a stirring shaft, and at such a height that they did not come into contact with the reaction solution.

After addition of the sodium behenate solution was completed, the solution was allowed to stand with stirring at a temperature left as it was, and then, the temperature was lowered to 25° C. Then, solid matter was filtered by suction filtration, and washed with water until a filtrate showed a conductivity of 30 μS/cm. Thus, a fatty acid silver salt was obtained. The resulting solid matter was not dried and stored as a wet cake.

The shape of the resulting silver behenate particles was evaluated taking electron photomicrographs. As a result, the silver behenate particles were scaly crystals having a of 0.14 μm, b of 0.4 μm and c of 0.6 μm in average, an average aspect ratio of 5.2, an average sphere corresponding diameter of 0.52 μm, and a coefficient of variation of sphere corresponding diameters of 15% (a, band care specified in this specification).

To a wet cake corresponding to 100 g of dried solid matter, 7.4 g of polyvinyl alcohol (trade name: PVA-217) and water were added to make the total weight of 385 g, and the resulting mixture was preliminarily dispersed with a homomixer.

Then, the original fluid preliminarily dispersed was treated three times with a dispersing device (trade name: Microfluidizer M-110S-EH, manufactured by Microfluidex International Corporation, using a G10Z interaction chamber) adjusting its pressure to 1750 kg/cm$^2$. Thus, a dispersed product of the fatty acid silver salt was obtained. For the cooling operation, coiled heat exchangers were each mounted in front of and behind the interaction chamber, and the temperature of a refrigerant was controlled thereby to set the dispersing temperature to 18° C.

(Preparation of 25 Wt % Dispersion of Reducing Agent)

To 10 kg of 1,1-bis(2-hydroxy-3,5-dimethylphenyl)-3,5,5-trimethylhexane and 10 kg of a 20 wt % aqueous solution of modified polyvinyl alcohol (Poval MP203, manufactured by Kuraray Co., Ltd.), 16 kg of water was added, and sufficiently mixed to prepare a slurry. This slurry was supplied with a diaphragm pump, and dispersed in a horizontal sand mill (UVM-2, manufactured by Imex Co., Ltd.) filled with zirconeia beads having an average diameter of 0.5 mm for 3 hours and 30 minutes. Then, 0.2 g of benzoisothiazolinone sodium salt and water were added thereto so as to give a reducing agent concentration of 25% by weight, thus obtaining a reducing agent dispersion. Reducing agent particles contained in the reducing agent dispersion thus obtained had a median diameter of 0.42 μm and a maximum particle size of 2.0 μm or less. The resulting reducing agent dispersion was filtered through a polypropylene filter having a pore size of 10.0 μm to remove foreign materials such as dust, and then stored.

(Preparation of 10 Wt % Dispersion of Mercapto Compound)

To 5 kg of 1-phenyl-2-heptyl-5-mercapto-1,3,4-triazole and 5 kg of a 20 wt % aqueous solution of modified polyvinyl alcohol (Poval MP203, manufactured by Kuraray Co., Ltd.), 8.3kg of water was added, and sufficiently mixed to prepare a slurry. This slurry was pumped with a diaphragm pump, and dispersed in a horizontal sand mill (UVM-2, manufactured by Imex Co., Ltd.) filled with zirconia beads having an average diameter of 0.5 mm for 6 hours. Then, water was added thereto so as to give a mercapto compound concentration of 10% by weight, thus obtaining a mercapto compound dispersion. Mercapto compound particles contained in the mercapto compounds dispersion thus obtained had a median diameter of 0.40 μm and a maximum particle size of 2.0 μm or less. The resulting mercapto compound dispersion was filtered through a polypropylene filter having a pore size of 10.0 μm to remove foreign materials such as dust, and then stored. The dispersion was further filtered again through a polypropylene filter having a pore size of 10 μm just before the use thereof.

(Preparation of 20 Wt % Dispersion of Organic Polyhalogen Compound 1)

To 5 kg of tribromomethylphenylsulfone and 2.5 kg of a 20 wt % aqueous solution of modified polyvinyl alcohol (Poval MP203, manufactured by Kuraray Co., Ltd.), 213 g of a 20 wt % aqueous solution of sodium triisopropylnaphthalenesulfonate and 10 kg of water were added, and sufficiently mixed to prepare a slurry. This slurry was pumped with a diaphragm pump, and dispersed in a horizontal sand mill (UVM-2, manufactured by Imex Co., Ltd.) filled with zirconia beads having an average diameter of 0.5 mm for 5 hours. Then, 0.2 g of benzoisothiazolinone sodium salt and water were added thereto so as to give an organic polyhalogen compound concentration of 20% by weight, thus obtaining an organic polyhalogen compound dispersion. Organic polyhalogen compound particles contained in the polyhalogen compound dispersion thus obtained had a median diameter of 0.36 μm and a maximum particle size of 2.0 μm or less. The resulting organic polyhalogen compound dispersion was filtered through a polypropylene filter having a pore size of 3.0 μm to remove foreign materials such as dust, and then stored.

(Preparation of 25 Wt % Dispersion of Organic Polyhalogen Compound 2)

A 25 wt % dispersion of organic polyhalogen compound 2 was prepared in the same manner as in the 20 wt % dispersion of organic polyhalogen compound 1 with the exception that 5 kg of tribromomethylphenylsulfone was substituted by 5 kg of tribromomethyl(4-(2,4,6-trimethylphenylsulfonyl)phenyl)sulfone, and the organic polyhalogen compound was diluted so as to give a concentration of 25% by weight. Organic polyhalogen compound particles contained in the polyhalogen compound dispersion thus obtained had a median diameter of 0.38 μm and a maximum particle size of 2.0 μm or less. The resulting organic polyhalogen compound dispersion was filtered through a polypropylene filter having a pore size of 3.0 μm to remove foreign materials such as dust, and then stored.

(Preparation of 30 Wt % Dispersion of Organic Polyhalogen Compound 3)

A 30 wt % dispersion of organic polyhalogen compound 3 was prepared in the same manner as in the 20 wt % dispersion of organic polyhalogen compound 1 with the exception that 5 kg of tribromomethylphenylsulfone was substituted by 5 kg of tribromomethylphenylsulfone, the amount of the 20 wt % aqueous solution of MP203 was changed to 5 kg, and the organic polyhalogen compound was diluted so as to give a concentration of 30% by weight. Organic polyhalogen compound particles contained in the polyhalogen compound dispersion thus obtained had a median diameter of 0.41 μm and a maximum particle size of 2.0 μm or less. The resulting organic polyhalogen compound dispersion was filtered through a polypropylene filter having a pore size of 3.0 μm to remove foreign materials such as dust, and then stored. The dispersion was kept at a temperature of 10° C. or less from storage to use.

(Preparation of 5 Wt % Solution of Phthalazine Compound)

Modified polyvinyl alcohol (MP203, manufactured by Kuraray Co., Ltd.) (8 kg) was dissolved in 174.57 kg of water, and then, 3.15 kg of a 20 wt % aqueous solution of sodium triisopropylnaphthalenesulfonate and 14.28 kg of a 70 wt % aqueous solution of 6-isopropylphthalazine were added thereto, thereby preparing a 5 wt % solution of 6-isopropylphthalazine.

(Preparation of 20 Wt % Dispersion of Pigment)

Water (250 g) was added to 64 g of C.I. Pigment Blue 60 and 6.4 g of Demol N manufactured by Kao Corp., and sufficiently mixed to prepare a slurry. The slurry was placed in a vessel together with 800 g of zirconia beads having an average diameter of 0.5 mm, and dispersed with a dispersing device (a ¼ G sand grinder mill, manufactured by Imex Co., Ltd.) for 25 hours to obtain a pigment dispersion. Pigment particles contained in the pigment dispersion thus obtained had an average particle size of 0.21 μm.

(Preparation of 40 wt % SBR latex)

Ultrafiltration (UF)-purified SBR latex was obtained in the following manner.

The following SBR latex was diluted with distilled water ten times, and diluted and purified using a module for UF-purification, FSO3-FC-FUYO3A1 (Daisen Membrane System Co., Ltd.) until the ion conductivity reached 1.5 mS/cm. Then, Sandet-BL manufactured by Sanyo Chemical Industries, Ltd. was added thereto so as to give a content of 0.22% by weight. Further, NaOH and $NH_4$ were added so as to give a molar ratio of $Na^+$ ions to $NH_4^+$ ions of 1:2.3, thereby adjusting the pH to 8.4. At this time, the latex concentration was 40% by weight.

(SBR Latex: Latex of -St(68)-Bu(29)-AA(3)-)

Average particle size: 0.1 μm, concentration: 45% by weight, equilibrium moisture content at 25° C., 60% RH: 0.6% by weight, ion conductivity: 4.2 mS/cm (the ion conductivity was measured for a stock solution (40%) of the latex at 25° C. by use of a CM-30S conductivity meter manufactured by Towa Denpa Kogyo Co., Ltd., pH: 8.2.)

(Preparation of Coating Solution for Emulsion Layer (Light-Sensitive Layer))

The 20 wt % aqueous dispersion of the pigment obtained above (1.1 g), 103 g of the organic acid silver dispersion, 5 g of the 20 wt % aqueous solution of polyvinyl alcohol PVA-205 (manufactured by Kuraray Co., Ltd.), 25 g of the above-described 25 wt % reducing agent dispersion, 16.3 g of the dispersions of organic polyhalogen compounds 1, 2 and 3 in total at a weight ratio of 5:1:3, 6.2 g of the 10% mercapto compound dispersion, 106 g of the 40 wt % ultrafiltration (UF)-purified, pH-adjusted SBR latex and 18 ml of the 5 wt % solution of the phthalazine compound were mixed, and 10 g of mixed silver halide emulsion A was sufficiently mixed with the mixture to prepare a coating solution for an emulsion layer. The solution was supplied to a coating die as such so as to give 70 ml/$m^2$ and applied.

The viscosity of the above-described coating solution for the emulsion layer was measured with a B type viscometer (No. 1 rotor, 60 rpm) of Tokyo Keiki Co., Ltd., and it was 85 [mPa·s] at 40° C.

The viscosity of the coating solution at 25° C. measured using an RFS fluid spectrometer manufactured by Rheometric Far East Co., Ltd., was 1500, 220, 70, 40 and 20 [mPa·s] at shear rates of 0.1, 1, 10, 100 and 1000 [1/sec.], respectively.

(Preparation of Coating Solution for Emulsion Face Intermediate Layer)

To 772 g of a 10 wt % aqueous solution of polyvinyl alcohol PVA-205 (manufactured by Kuraray Co., Ltd.), 5.3 g of the 20 wt % pigment dispersion and 226 g of a 27.5 wt % solution of methyl methacrylate/styrene/butyl acrylate/hydroxyethyl methacrylate/acrylic acid copolymer (copolymerization weight ratio: 64/9/20/5/2) latex, 2 ml of a 5 wt % aqueous solution of Aerosol OT (manufactured by American Cyanamide) and 10.5 ml of a 20 wt % aqueous solution of diammonium phthalate were added. Then, water was added to bring the total weight to 880 g. The resulting solution was adjusted to pH 7.5 with NaOH, and supplied to a coating die so as to give 10 ml/$m^2$ as a coating solution for an intermediate layer.

The viscosity of the coating solution measured with a B type viscometer (No. 1 rotor, 60 rpm) at 40° C. was 21 [mPa·s].

(Preparation of Coating Solution for First Emulsion Face Protective Layer)

Inert gelatin (64 g) was dissolved in water, and 80 g of a 27.5 wt % solution of methyl methacrylate/styrene/butyl acrylate/hydroxyethyl methacrylate/acrylic acid copolymer (copolymerization weight ratio: 64/9/20/5/2) latex, 23 ml of a 10 wt % solution of phthalic acid in methanol, 23 ml of a 10 wt % aqueous solution of 4-methylphthalic acid, 28 ml of 1 N sulfuric acid, 5 ml of a 5 wt % aqueous solution of Aerosol OT (manufactured by American Cyanamide), 0.5 g of phenoxyethanol and 0.1 g of benzoisothiazolinone were added thereto. Then, water was added thereto to bring the total weight to 750 g, thus preparing a coating solution, which was mixed with 26 ml of 4 wt % chrome alumin a static mixer just before coating, and supplied to a coating die so as to give 18.6 ml/$m^2$.

The viscosity of the coating solution measured with a B type viscometer (No. 1 rotor, 60 rpm) at 40° C. was 17 [mPa·s].

(Preparation of Coating Solution for Second Emulsion Face Protective Layer)

Inert gelatin (80 g) was dissolved in water, and 102 g of a 27.5 wt % solution of methyl methacrylate/styrene/butyl acrylate/hydroxyethyl methacrylate/acrylic acid copolymer (copolymerization weight ratio: 64/9/20/5/2) latex, 3.2 ml of a 5 wt % solution of N-perfluorooctylsulfonyl-N-propylalanine potassium salt, 32 ml of a 2 wt % aqueous solution of polyethylene glycol mono(N-perfluorooctylsulfonyl-N-propyl-2-aminoethyl)ether (average degree of ethylene oxide polymerization: 15), 23 ml of a 5 wt % solution of Aerosol OT (manufactured by American Cyanamide), 4 g of fine polymethyl methacrylate particles (average particle size: 0.7 μm), 21 g of fine polymethyl methacrylate particles (average particle size: 6.4 μm), 1.6 g of 4-methylphthalic acid, 4.8 g of phthalic acid, 44 ml of 0.5 mol/L sulfuric acid and 10 mg of benzoisothiazolinone were added thereto. Then, water was added thereto to bring the total weight to 650 g, and the resulting solution was mixed with 445 ml of an aqueous solution containing 4% by weight of chrome alum and 0.67% by weight of phthalic acid in a static mixer just before coating to prepare a coating solution for a surface protective layer, which was supplied to a coating die so as to give 8.3 ml/$m^2$.

The viscosity of the coating solution was measured with a B type viscometer (No. 1 rotor, 60 rpm) at 40° C. was 9 [mPa·s].

(Preparation of Photothermographic Material)

The back face side of the above-described undercoated support was simultaneously coated in multiple layers with the coating solution for the antihalation layer so as to give an amount of solid matter coated of the fine solid particle dye of 0.04 g/$m^2$ and with the coating solution for the protective layer so as to give an amount of gelatin coated of 1.7 g/$m^2$ in multiple layers, followed by drying to prepare an antihalation back layer.

Then, the emulsion layer, the intermediate layer, the first protective layer and the second protective layer were simultaneously coated in multiple layers from the undercoat face on the side opposite to the back face in this order by the slide speed coating system to prepare photothermographic material sample 1.

The coating was carried out at a speed of 160 m/min., and the clearance between the tip of the coating die and the support was set to 0.10 mm to 0.30 mm. The pressure in a vacuum chamber was set to a pressure of 196 Pa to 882 Pa lower than atmospheric pressure. Static was eliminated from the support by ionic air.

In a subsequent chilling zone, the coating solution was cooled by air having a dry-bulb temperature of 10° C. to 20° C., followed by non-contact type transfer. Then, the sample was dried by dry air having a dry-bulb temperature of 23° C. to 45° C. and a wet-bulb temperature of 15° C. to 21° C. in a helical non-contact type drying apparatus.

After drying, the sample was subjected to moisture conditioning at 25° C. and 40% to 60% RH, and then, heated so that the temperature of the film surface was elevated to 70° C. to 90° C. After heating, the film surface was cooled to 25° C.

The matte degree of the photothermographic material prepared was 550 seconds on the light-sensitive layer face side and 130 seconds on the back face, by the Bekk's smoothness. Further, measurement of the pH of the film surface on the light-sensitive layer side showed 6.0.

Tellurium Sensitizer B

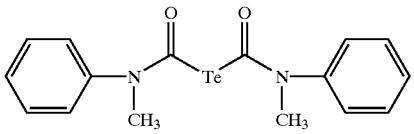

Base Precursor Compound 11

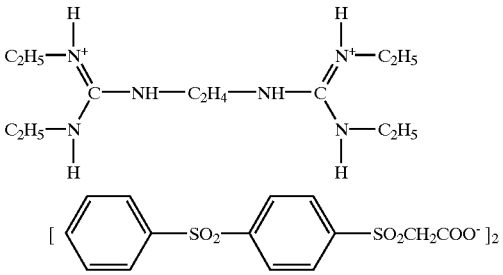

Cyanine Dye Compound 13

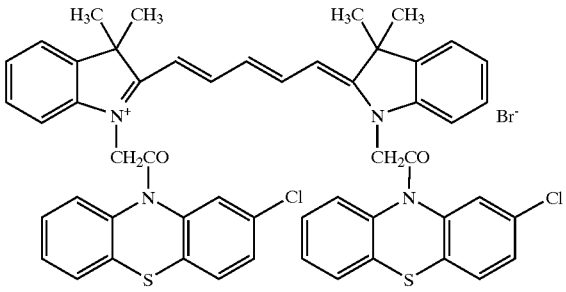

-continued

Blue Dye Compound 14

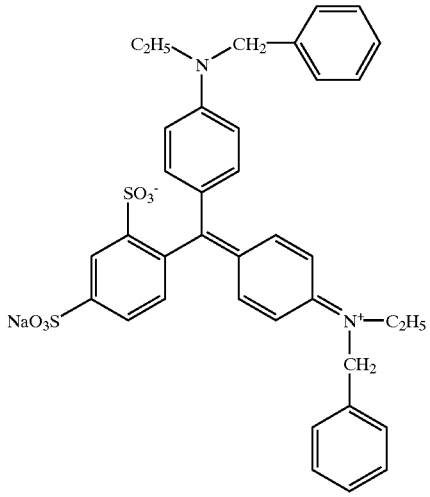

Yellow Dye Compound 15

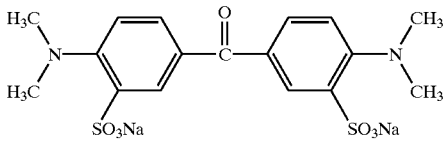

Further, using dye 35 (dye for comparison) in place of dye 30 (dye for comparison) of sample 1, example dyes 1, 4, 9, 23and 27 of the present invention, and combinations of the example dyes of the present invention and dye 30, samples 2 to 9 were prepared. When the combinations of the dyes were used, the total amount of the dyes was adjusted to the same as that of dye 30.

(Evaluation of Photographic Characteristics)

Using a Fuji medical dry laser imager FM-DPL (equipped with a 660-nm semiconductor laser having a maximum output of 60 mW (IIIB)), the photographic materials were exposed and heat developed (at about 120° C.). The resulting images were evaluated with a densitometer. In that case, they were exposed at temperatures of 32° C. and 13° C.

Results of the measurement were evaluated by Dmin and the sensitivity (the reciprocal of a ratio of an exposure giving a density 1.0 higher than Dmin). The sensitivity was indicated by the relative value, taking the sensitivity of sample 1 as 100.

(Evaluation of Shelf life (i.e., Storage Stability))

Each sample was cut to a size of 30.5 cm×25.4 cm, and corners were rounded to 0.5-cm round corners. Each sample was allowed to stand under the conditions of 25° C. and 50% RH for 1 day. One sheet of each sample was sealed in a bag made of a moisture-proof material, and further placed in a fancy box of 35.1 cm×26.9 cm×3.0 cm, followed by aging at 50° C. for 5 days (forced aging). The sample was evaluated in the same manner as used in the evaluation of photographic characteristics evaluate Dmin and the sensitivity. Results of the evaluation are shown in Table 1.

TABLE 1

| Sample | Dye | Exposure Temp. (32° C.) Sensitivity | Dmin | Exposure Temp. (13° C.) Sensitivity | Dmin | After Ageing Exposure Temp. (32° C.) Sensitivity | Dmin | Remark |
|---|---|---|---|---|---|---|---|---|
| 1 | 30 | 100 (standard) | 0.18 | 62 | 0.16 | 82 | 0.26 | Comparison |
| 2 | 35 | 88 | 0.16 | 55 | 0.16 | 60 | 0.30 | Comparison |
| 3 | 1 | 124 | 0.16 | 98 | 0.16 | 120 | 0.18 | Invention |
| 4 | 4 | 141 | 0.12 | 108 | 0.12 | 136 | 0.15 | Invention |
| 5 | 9 | 144 | 0.11 | 110 | 0.11 | 140 | 0.17 | Invention |
| 6 | 23 | 116 | 0.12 | 103 | 0.14 | 108 | 0.17 | Invention |
| 7 | 27 | 114 | 0.11 | 102 | 0.11 | 112 | 0.15 | Invention |
| 8 | 1 + 30* | 140 | 0.11 | 120 | 0.12 | 139 | 0.15 | Invention |
| 9 | 4 + 30* | 166 | 0.11 | 136 | 0.11 | 164 | 0.15 | Invention |

*Mixing Ratio: 1:1 (mol%)

The results of Table 1 show that samples 3 to 9 using the sensitizing dyes of the present invention have high sensitivity, low fog, low dependence on exposure temperature and good shelf life (i.e., storage stability). In particular, when two kinds of dyes are used together, the effects are significant.

EXAMPLE 2

In Example 1 of JP-A-7-287337, dye 30 for comparison and example dye 4 in the present invention were used in place of the sensitizing dye described in the example of JP-A-7-287337 to prepare samples 10 and 11. Each sample was exposed by the method described in "Evaluation of Photographic Characteristics" of Example 1 of the present invention, and subjected to processing described in JP-A-7-287337 in place of heat development. Then, the photographic characteristics were evaluated. Taking the sensitivity of sample 10 as 100, the sensitivity of sample 11 was 116, and the high sensitivity was obtained.

EXAMPLE 3

In Example 1, silver halide emulsion 4 prepared in the following manner was used instead of silver halide emulsion 1.

(Preparation of Silver Halide Emulsion 4)

To 1421 ml of distilled water, 6.7 ml of 1 wt % solution of potassium bromide was added, and 8.2 ml of 1 N nitric acid and 21.8 g of phthalated gelatin were further added thereto. The resulting solution was maintained at 35° C. in a titanium-coated stainless steel reaction pot with stirring. On the other hand, solution al was prepared by diluting 37.04 g of silver nitrate with distilled water to 159 ml, and solution b1 was prepared by diluting 32.6 g of potassium bromide with distilled water to a volume of 200 ml. Solution al was wholly added by the controlled double jet method at a constant flow rate for 1 minute while maintaining the pAg at 8.1 (solution bl was added by the controlled double jet method.). Then, 30 ml of a 3.5% aqueous solution of hydrogen peroxide was added, and 336 ml of a 3 wt % aqueous solution of benzimidazole was further added. Thereafter, solution a2 was prepared by diluting solution a1 with distilled water to 317.5 ml, and solution b2 was prepared by dissolving dipotassium iridate hexachloride in solution b1 so as to finally give $1\times10^{-4}$ mol per mol of silver, and diluting it with water to 400 ml, twice the volume of solution b1. Solution a2 was wholly added by the controlled double jet method at a constant flow rate for 10 minutes while maintaining the pAg at 8.1 (solution b2 was added by the controlled double jet method.). Then, 50 ml of a 0.5% solution of 2-mercapto-5-methylbenzimidazole in methanol was added, and after the pAg was increased to 7.5 with silver nitrate, the pH was adjusted to 3.8 using 1 N sulfuric acid. Then, stirring was stopped, and sedimentation/desalting/washing steps were carried out. Then, 3.5 g of deionized gelatin was added and 1 N sodium hydroxide was added to adjust the pH and the pAg to 6.0 and 8.2, respectively, to prepare a silver halide dispersion.

Grains in the resulting silver halide emulsion were pure silver bromide grains having an average sphere corresponding diameter (i.e., an average equivalent sphere diameter) of 0.031 $\mu$m and a coefficient of variation of sphere corresponding diameters of 11%. The grain size was determined from an average of 1000 grains using an electron microscope. The [100] face ratio of the grains determined by the Kubelka-Munk method was 85%.

The temperature of the emulsion was elevated to 50° C. with stirring, and 5 ml of a 0.5 wt % solution of N,N'-dihydroxy-N",N"-diethylmelamine in methanol and 5 ml of a 3.5 wt % solution of phenoxyethanol in methanol were added. After one minute, sodium benzenethiosulfonate was added in an amount of $3\times10^{-5}$ mol per mol of silver, and after further 2 minutes, a solid dispersion (an aqueous solution of gelatin) of dye 35 for comparison was added in an amount of $5\times10^{-3}$ mol per mol of silver. After still further 2 minutes,-an additive for comparison was added in an amount of $1\times10^{-4}$ mol per mol of silver, followed by ripening for 50 minutes. Just before the ripening was completed, 2-mercapto-5-methylbenzimidazole was added in an amount of $1\times10^{-3}$ mol per mol of silver, and the temperature was lowered to terminate the chemical sensitization, thereby preparing silver halide emulsion 4.

Sample 12 was prepared in the same manner as in Example 1 except for the above. Samples 13, 14 and 15 were prepared using example dyes 1, 4 and 4+30, respectively, as sensitizing dyes in place of dye 35 for comparison.

Additive for Comparison

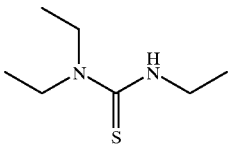

For these samples, the photographic characteristics were evaluated in the same manner as in Example 1. Results thereof are shown in Table 2.

TABLE 2

| Sample | Dye | Additive | Temp. (° C.) | Sensitivity | Dmin | Sensitivity after Aging | Dmin after Aging | Remark |
|---|---|---|---|---|---|---|---|---|
| 2 | 35 | Tellurium Compound | 50 | 88 | 0.16 | 60 | 0.30 | Comparison |
| 3 | 1 | Tellurium Compound | 50 | 124 | 0.16 | 120 | 0.18 | Invention |
| 4 | 4 | Tellurium Compound | 50 | 141 | 0.12 | 136 | 0.15 | Invention |
| 5 | 4 + 30* | Tellurium Compound | 50 | 166 | 0.11 | 164 | 0.15 | Invention |
| 12 | 35 | Additive for Comparison | 50 | 82 | 0.14 | 44 | 0.26 | Comparison |
| 13 | 1 | Additive for Comparison | 50 | 116 | 0.14 | 82 | 0.16 | Invention |
| 14 | 4 | Additive for Comparison | 50 | 128 | 0.12 | 80 | 0.16 | Invention |
| 15 | 4 + 30* | Additive for Comparison | 50 | 140 | 0.12 | 108 | 0.18 | Invention |

The results show that the dyes of the present invention provide higher sensitivity, lower fog and better shelf life (i.e., storage stability) than the dyes for comparison. Further, when the silver halide emulsion layers containing the sensitizing dyes in the present invention are sensitized with the tellurium compounds, the photothermographic materials having particularly high sensitivity, low fog and good shelf life (i.e., storage stability) can be obtained.

EXAMPLE 4

In Example 1 of JP-A-7-194282, cyanine dye compound 13 and base precursor compound 11 used in Example 1 of the present invention were used in place of the dyes described in JP-A-7-194282, and sensitizing dye A described in JP-A-7-194282 and example dye 4 were used to prepare samples 16 and 17, respectively. For each sample, the photographic characteristics were evaluated by the method described in "Evaluation of Photographic Characteristics" of Example 1 of the present invention. As a result, results similar to those of the sample obtained in Example 1 of the present invention were obtained.

According to the present invention, the silver halide photographic materials, particularly the photothermographic materials, having high sensitivity, low fog and good shelf life (i.e., storage stability) were obtained.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising at least one kind of merocyanine dye represented by formula (II):

(II)

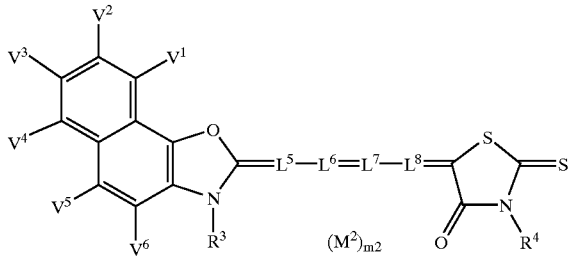

wherein $R^3$ and $R^4$ each represents an unsubstituted or substituted alkyl group, an aryl group or a heterocyclic group, $V^1$, $V^2$, $V^3$, $V^4$, $V^5$ and $V^6$ each represents a hydrogen atom or a substituent, $L^5$, $L^6$, $L^7$ and $L^8$ each represents a methine group, $M^2$ represents a charge neutralizing counter ion, and $m^2$ is a number of 0 or more necessary for neutralizing a charge in a molecule.

2. A photothermographic material having a support containing at least one kind of light-sensitive silver halide, a light-insensitive organic silver salt, a reducing agent for a silver ion and a binder in one face thereof, which comprises at least one kind of merocyanine dye represented by formula (I) or (II):

(I)

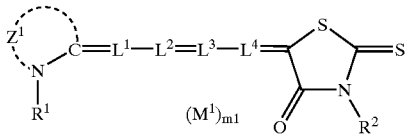

wherein $Z^1$ represents an atomic group necessary for forming a naphthoxazole ring, $R^1$ and $R^2$ each represents an unsubstituted or substituted alkyl group, an aryl group or a heterocyclic group, $L^1$, $L^2$, $L^3$ and $L^4$ each represents a methine group, $M^1$ represents a charge neutralizing counter ion, and $m^1$ is a number of 0 or more necessary for neutralizing a charge in a molecule; and (II)

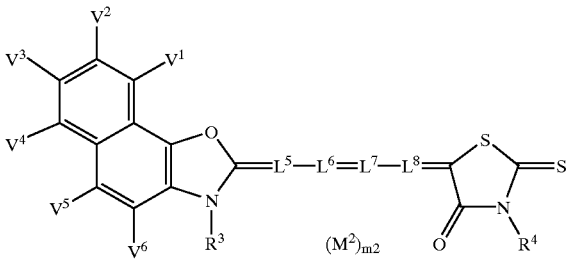

wherein $R^3$ and $R^4$ each represents an unsubstituted or substituted alkyl group, an aryl group or a heterocyclic group, $V^1$, $V^2$, $V^3$, $V^4$, $V^5$ and $V^6$ each represents a hydrogen atom or a substituent, $L^5$, $L^6$, $L^7$ and $L^8$ each represents a methine group, $M^2$ represents a charge neutralizing counter ion, and $m^2$ is a number of 0 or more necessary for neutralizing a charge in a molecule.

3. The silver halide photographic material as in claim 1, wherein $R^4$ in the merocyanine dye represented by formula (II) is a carboxymethyl group.

4. The photothermographic material as in claim 2, wherein $R^4$ in the merocyanine dye represented by formula (II) is a carboxymethyl group.

5. The silver halide photographic material as in claim 1, wherein $V^1$, $V^2$, $V^3$, $V^4$, $V^5$ and $V^6$ in the merocyanine dye represented by formula (II) are hydrogen atoms.

6. The photothermographic material as in claim 2, wherein $V^1$, $V^2$, $V^3$, $V^4$, $V^5$ and $V^6$ in the merocyanine dye represented by formula (II) are hydrogen atoms.

7. A silver halide photographic material comprising at least one kind of merocyanine dye represented by formula (II) and at least one kind of merocyanine dye represented by formula (III):

(II)

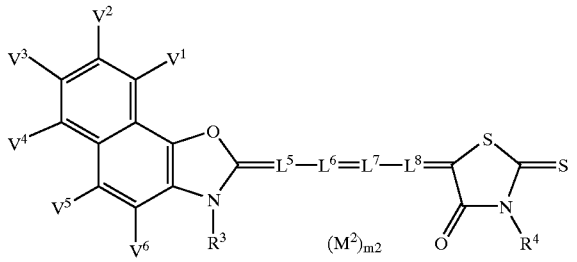

wherein $R^3$ and $R^4$ each represents an unsubstituted or substituted alkyl group, an aryl group or a heterocyclic group, $V^1$, $V^2$, $V^3$, $V^4$, $V^5$, and $V^6$ each represents a hydrogen atom or a substituent, $L^5$, $L^6$, $L^7$ and $L^8$ each represents a methine group, $M^2$ represents a charge neutralizing counter ion, and $m^2$ is a number of 0 or more necessary for neutralizing a charge in a molecule; and (III)

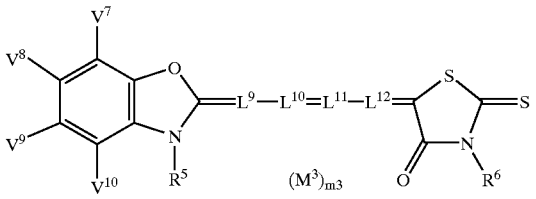

wherein $R^5$ and $R^6$ each represents an unsubstituted or substituted alkyl group, an aryl group or a heterocyclic group, $V^7$, $V^8$, $V^9$ and $V^{10}$ each represents a hydrogen atom or a substituent, $L^9$, $L^{10}$, $L^{11}$ and $L^{12}$ each represents a methine group, $M^3$ represents a charge neutralizing counter ion, and $m^3$ is a number of 0 or more necessary for neutralizing a charge in a molecule.

8. The silver halide photographic material as in claim 7, wherein $V^7$ and $V^{10}$ in the merocyanine dye represented by formula (III) are each a hydrogen atom, and $V^8$ and $V^9$ therein are each an unsubstituted or substituted alkyl group.

9. The silver halide photographic material as in claim 1, wherein $R^5$ in the merocyanine dye represented by formula (II) is an unsubstituted alkyl group having 5 to 10 carbon atoms.

10. The photothermographic material as in claim 2, wherein $R^5$ in the merocyanine dye represented by formula (II) is an unsubstituted alkyl group having 5 to 10 carbon atoms.

11. The silver halide photographic material as in claim 7, wherein $R^5$ in the merocyanine dye represented by formula (II) is an unsubstituted alkyl group having 5 to 10 carbon atoms.

12. The silver halide photographic material as in claim 1, wherein a silver halide emulsion containing the merocyanine dye represented by formula (II) is sensitized with a tellurium sensitizer.

13. The phototheremographic material as in claim 2, wherein a silver halide emulsion containing the merocyanine dye represented by formula (II) is sensitized with a tellurium sensitizer.

14. The silver halide photographic material as in claim 7, wherein a silver halide emulsion containing the merocyanine dye represented by formula (II) is sensitized with a tellurium sensitizer.

15. The silver halide photographic material as in claim 1, wherein $R^3$ represents an unsubstituted alkyl group having from 1 to 18 carbon atoms, a substituted alkyl group having from 1 to 18 carbon atoms, an unsubstituted hydrocarbon group, a hydroxyalkyl group, a carboxyalkyl group, an alkoxyalkyl group, an aryloxyalkyl group, an alkoxycarbonylalkyl group, an aryloxycarbonylalkyl group, an acyloxyalkyl group, an acylalkyl group, a carbamoylalkyl group, a sulfamoylalkyl group, a sulfoalkyl group, a sulfoalkenyl group, a sulfatoalkyl group, a heterocycle-substituted alkyl group and an alkylsulfonylcarbamoylmethyl group, an unsubstituted aryl group having from 6 to 20 carbon atoms, a substituted aryl group having from 6 to 20 carbon atoms, an unsubstituted heterocyclic group having from 1 to 20 carbon atoms, or a substituted heterocyclic group having from 1 to 20 carbon atoms.

16. The photothermographic material as in claim 2, wherein $R^3$ represents an unsubstituted alkyl group having from 1 to 18 carbon atoms, a substituted alkyl group having from 1 to 18 carbon atoms, an unsubstituted hydrocarbon group, a hydroxyalkyl group, a carboxyalkyl group, an alkoxyalkyl group, an aryloxyalkyl group, an alkoxycarbonylalkyl group, an aryloxycarbonylalkyl group, an acyloxyalkyl group, an acylalkyl group, a carbamoylalkyl group, a sulfamoylalkyl group, a sulfoalkyl group, a sulfoalkenyl group, a sulfatoalkyl group, a heterocycle-substituted alkyl group and an alkylsulfonylcarbamoylmethyl group, an unsubstituted aryl group having from 6 to 20 carbon atoms, a substituted aryl group having from 6 to 20 carbon atoms, an unsubstituted heterocyclic group having from 1 to 20 carbon atoms, or a substituted heterocyclic group having from 1 to 20 carbon atoms.

17. The silver halide photographic material as in claim 7, wherein $R^3$ represents an unsubstituted alkyl group having from 1 to 18 carbon atoms, a substituted alkyl group having from 1 to 18 carbon atoms, an unsubstituted hydrocarbon group , a hydroxyalkyl group, a carboxyalkyl group, an alkoxyalkyl group, an aryloxyalkyl group, an alkoxycarbonylalkyl group, an aryloxycarbonylalkyl group, an acyloxyalkyl group, an acylalkyl group, a carbamoylalkyl group, a sulfamoylalkyl group, a sulfoalkyl group, a sulfoalkenyl group, a sulfatoalkyl group, a heterocycle-substituted alkyl group and an alkylsulfonylcarbamoylmethyl group, an unsubstituted aryl group having from 6 to 20 carbon atoms, a substituted aryl group having from 6 to 20 carbon atoms, an unsubstituted heterocyclic group having from 1 to 20 carbon atoms, or a substituted heterocyclic group having from 1 to 20 carbon atoms.

18. The silver halide photographic material as in claim 1, wherein $R^4$ represents an unsubstituted alkyl group having from 1 to 18 carbon atoms, an aralkyl group, a hydroxyalkyl group, a mercaptoalkyl group, a carboxyalkyl group, an alkoxyalkyl group, an aryloxyalkyl group, a sulfoalkyl group, a sulfatoalkyl group, an arylthioalkyl group, a heterocycle-substituted alkyl group, 2-acetoxyethyl, carbomethoxymethyl or 2-methanesulfonylaminoethyl.

19. The photothermographic material as in claim 2, wherein $R^4$ represents an unsubstituted alkyl group having from 1 to 18 carbon atoms, an aralkyl group, a hydroxyalkyl group, a mercaptoalkyl group, a carboxyalkyl group, an alkoxyalkyl group, an aryloxyalkyl group, a sulfoalkyl group, a sulfatoalkyl group, an arylthioalkyl group, a heterocycle-substituted alkyl group, 2-acetoxyethyl, carbomethoxymethyl or 2-methanesulfonylaminoethyl.

20. The silver halide photographic material as in claim 7, wherein $R^4$ represents an unsubstituted alkyl group having from 1 to 18 carbon atoms, an aralkyl group, a hydroxyalkyl group, a mercaptoalkyl group, a carboxyalkyl group, an alkoxyalkyl group, an aryloxyalkyl group, a sulfoalkyl group, a sulfatoalkyl group, an arylthioalkyl group, a heterocycle-substituted alkyl group, 2-acetoxyethyl, carbomethoxymethyl or 2-methanesulfonylaminoethyl.

* * * * *